US006877971B2

(12) United States Patent
Kurihara et al.

(10) Patent No.: US 6,877,971 B2
(45) Date of Patent: Apr. 12, 2005

(54) APPARATUS FOR PRODUCING A TRANSVERSELY ALIGNED WEB IN WHICH FILAMENTS SPUN AT HIGH RATE ARE ALIGNED IN THE TRANSVERSE DIRECTION

(75) Inventors: Kazuhiko Kurihara, Tokyo (JP); Yoichi Mazawa, Saitama (JP); Yoshiro Morino, Chiba (JP)

(73) Assignees: Nippon Petrochemicals Co. Ltd., Tokyo (JP); Polymer Processing Research Institute, Ltd., Tokyo (JP)

( * ) Notice: Subject to any disclaimer, the term of this patent is extended or adjusted under 35 U.S.C. 154(b) by 207 days.

(21) Appl. No.: 10/270,887

(22) Filed: Oct. 14, 2002

(65) Prior Publication Data

US 2003/0056335 A1 Mar. 27, 2003

Related U.S. Application Data

(62) Division of application No. 09/676,879, filed on Sep. 29, 2000, now Pat. No. 6,495,078.

(30) Foreign Application Priority Data

Sep. 30, 1999 (JP) ..... 11-279191

(51) Int. Cl.[7] ..... D01D 5/088; D01D 10/00

(52) U.S. Cl. ..... 425/72.2; 425/382.2; 425/464

(58) Field of Search ..... 425/72.2, 382 R, 425/72.1, 382.2, 464

(56) References Cited

U.S. PATENT DOCUMENTS

| | | | | |
|---|---|---|---|---|
| 3,485,428 A | | 12/1969 | Jackson | 226/97.4 |
| 5,080,569 A | * | 1/1992 | Gubernick et al. | 425/7 |
| 5,695,377 A | * | 12/1997 | Triebes et al. | 442/359 |
| 5,840,633 A | | 11/1998 | Kurihara et al. | 442/361 |
| 6,063,717 A | | 5/2000 | Ishiyama et al. | 422/387 |
| 6,247,911 B1 | * | 6/2001 | Milligan | 425/7 |

FOREIGN PATENT DOCUMENTS

| | | |
|---|---|---|
| EP | 0979885 A2 | 2/2000 |
| EP | 0 414 917 B2 | 1/2001 |
| JP | 2-242760 | 9/1990 |
| JP | 2-269839 | 11/1990 |
| JP | 3-36948 | 6/1991 |

* cited by examiner

*Primary Examiner*—Joseph S. Del Sole
(74) *Attorney, Agent, or Firm*—Knobbe Martens Olson & Bear LLP

(57) ABSTRACT

The present invention relates to an apparatus for producing a transversely aligned web having filaments aligned in the transverse direction, comprising conveyor running in one direction, spinning nozzle disposed above the conveyor, an annular primary airflow nozzle, and at least one pair of secondary airflow nozzles disposed on the upstream side and the downstream side of the running direction of the conveyor.

7 Claims, 11 Drawing Sheets

FIG.7

| | A Spinning head | B Polymer | C Rate of extrusion [g/min.] | D Temperature of spinning head | E Temperature and Wind quantity of primary airflow | F Temperature and Wind quantity of secondary airflow | G Width of web [mm] | H Diameter of fiber and Coefficient of fluctuation | I Spinning rate [m/min.] | J Tensile strength and Elongation before stretching | K Stretching magnification ratio | L Tensile strength and Elongation after stretching | Note |
|---|---|---|---|---|---|---|---|---|---|---|---|---|---|
| Experimental example 1 | ① | PP MFR 500 | 102 | 300℃ | 450℃ 120L/min. | 350℃ 180L/min. | 520 | 24μm 28% | 250,649 | 15.89mN/tex (0.18g/d) 350% | 8. 3 | 238.4mN/tex (2.7g/d) 15% | |
| Experimental example 2 | ① | PET IV 0.55 | 75 | 350℃ | 500℃ 140L/min. | 400℃ 200L/min. | 480 | 27μm 31% | 97,805 | 15.01mN/tex (0.17g/d) 240% | 6. 0 | 194.3mN/tex (2.2g/d) 8% | |
| Experimental example 3 | ② | PET IV 0.55 | 20 | 320℃ | 400℃ 90L/min. | 350℃ 120L/min. | 310 | 25μm 18% | 30,421 | 18.54mN/tex (0.21g/d) 260% | 5. 8 | 220.8mN/tex (2.5g/d) 10% | |
| Experimental example 4 | ③ | PET IV 0.55 | 50 | 370℃ | 450℃ 150L/min. | 370℃ 200L/min. | 410 | 29μm 33% | 56,520 | 14.13mN/tex (0.16g/d) 180% | 5. 5 | 150.1mN/tex (1.7g/d) 8% | grains exist |
| Comparison example 1 | ④ | PET IV 0.55 | 30 | 350℃ | 400℃ 85L/min. | 350℃ 100L/min. | 250 | 27μm 41% | 39,122 | 9.71mN/tex (0.11g/d) 120% | 5. 0 | 106.0mN/tex (1.2g/d) 7% | |
| Comparison example 2 | ⑤ | PET IV 0.55 | 30 | 370℃ | 450℃ 120L/min. | 370℃ 150L/min. | 320 | 43μm 57% | 15,424 | 6.18mN/tex (0.07g/d) 110% | 4. 7 | 61.8mN/tex (0.7g/d) 8% | large grain |
| Comparison example 3 | ⑥ | PET IV 0.55 | 30 | 350℃ | 450℃ 120L/min. | 350℃ 150L/min. | 360 | 28μm 38% | 36,377 | 11.48mN/tex (0.13g/d) 150% | 4. 9 | 97.1mN/tex (1.1g/d) 7% | hill shape |
| Comparison example 4 | ⑦ | PET IV 0.55 | 30 | 350℃ | 450℃ 95L/min. | 350℃ 110L/min. | 320 | 22μm 29% | 58,925 | 15.89mN/tex (0.18g/d) 250% | 5. 7 | 185.4mN/tex (2.1g/d) 12% | excessive dumbbell shape |
| Comparison example 5 | ⑧ | PET IV 0.55 | 30 | 350℃ | 450℃ 95L/min. | 350℃ 80L/min. | 220 | 38μm 35% | 19,751 | 10.60mN/tex (0.12g/d) 160% | 4. 5 | 123.6mN/tex (1.4g/d) 7% | |

FIG.8

| | Spinning head | Nozzle diameter $N_z$[mm] | Inner diameter of primary airflow nozzle d [mm] | Outer diameter of primary airflow nozzle D [mm] | Projection height of spinning nozzle part H [mm] | Inner diameter of small aperture q [mm] | Diameter of secondary airflow nozzle r [mm] | The smallest gap of the annular aperture S [mm] |
|---|---|---|---|---|---|---|---|---|
| Experimental examples 1, 2 | ① | 0. 7 | 3. 0 | 3. 5 | 0. 2 | 0. 7 | 2. 0 | 0. 3 |
| Experimental example 3 | ② | 0. 6 | 2. 5 | 3. 0 | 0. 3 | 0. 7 | 2. 0 | 5. 0 |
| Experimental example 4 | ③ | 0. 85 | 3. 0 | 3. 8 | 0. 2 | 1. 0 | 2. 0 | 5. 0 |
| Comparison example 1 | ④ | 0. 5 | 2. 0 | 2. 7 | 1. 2 | 0. 7 | 1. 5 | 2. 5 |
| Comparison example 2 | ⑤ | 0. 9 | 2. 0 | 2. 7 | 0. 2 | 1. 0 | 2. 0 | 2. 0 |
| Comparison example 3 | ⑥ | 0. 7 | 7. 0 | 7. 5 | 0. 5 | 1. 0 | 2. 0 | 5. 0 |
| Comparison example 4 | ⑦ | 0. 6 | 2. 0 | 2. 7 | −0. 2 | 0. 7 | 2. 0 | 1. 5 |
| Comparison example 5 | ⑧ | 0. 7 | 2. 5 | 3. 0 | 0. 3 | 0. 7 | 1. 2 | 5. 0 |

APPARATUS FOR PRODUCING A TRANSVERSELY ALIGNED WEB IN WHICH FILAMENTS SPUN AT HIGH RATE ARE ALIGNED IN THE TRANSVERSE DIRECTION

CROSS-REFERENCE TO RELATED APPLICATIONS

This application is a divisional of U.S. application Ser. No. 09/676,879, filed Sep. 29, 2000, now issued U.S. Pat. No. 6,495,078, which claims priority to Japanese Patent Application No. 11-279191, filed Sep. 30, 1999.

BACKGROUND OF THE INVENTION

1. Field of the Invention

The present invention relates to a method of producing a transversely aligned web in which filaments spun at a high rate are aligned in the transverse direction and an apparatus for implementing the method of the same. The transversely aligned web is utilized as a raw material web of a transversely stretched nonwoven fabric. Further, the transversely aligned web is utilized as a raw material web for producing a cross laminated nonwoven fabric in which a transversely stretched nonwoven fabric is laid on a longitudinally aligned nonwoven fabric or the like so that the aligning directions thereof cross to each other.

2. Description of the Related Art

Most of the conventional nonwoven fabric is a random nonwoven fabric in which alignment of filaments composing the nonwoven fabric is random. Therefore, the tensile strength thereof is weak and the dimension of the product is unstable. As an invention made for improving such drawback which the conventional nonwoven fabric encounters, there can be introduced Japanese Patent Publication No. 36948/91, Japanese Patent No. 2612203, Japanese Patent Publication No. 6126/95 or the like filed by the present applicant. According to the above publications, there is introduced a lamination type nonwoven fabric in which at least two sheets of nonwoven fabric as a raw material are stretched and the sheets of nonwoven fabric are laid on and bonded to one another so that the directions of stretching thereof cross to each other. Also, a method of producing such a nonwoven fabric is introduced in the above publications.

Japanese Patent Publication No. 36948/91 discloses a method of producing nonwoven fabric in which un-oriented filaments are spun to produce a long fiber nonwoven fabric, and the resulting nonwoven fabric is stretched in one direction under a proper temperature so that the fabric tends to contain a larger rate of filament components aligned in one direction. Also in the patent publication, there is disclosed a method in which sheets of nonwoven fabric stretched by the above method are laid on each other so that the stretching directions of the nonwoven fabrics cross to each other.

Further, Japanese Patent Publication No. 36948/91 discloses a method of producing a long fiber nonwoven fabric in which the nonwoven fabric is produced by using un-oriented filaments aligned in one direction. According to the method of producing the long fiber nonwoven fabric, initially, filaments are produced by extrusion through a nozzle which is provided above a screen mesh running in one direction. Then, the filaments are dispersed by a heated airflow which flows spirally. Further, a pair of airflows are created below the nozzle so that the airflows collide with each other. The rotated spun filaments are further dispersed by the spreading airflow resulting from the collision of the airflows. In this case, if the moving direction of the airflows colliding with each other is in parallel with the running direction of the screen mesh, then the spun filaments are dispersed in a direction perpendicular to the running direction of the screen mesh. Thus, dispersed filaments are piled on the screen mesh and a piece of nonwoven fabric can be created on the screen mesh so that a majority of filaments are aligned in the transverse direction of the fabric. In this way, nonwoven fabric mainly containing filaments aligned in the transverse direction is produced. Conversely, if the moving direction of the airflows colliding with each other is substantially perpendicular to the running direction of the screen mesh, then the spun filaments are dispersed in a direction in parallel with the running direction of the screen mesh. Thus, when dispersed filaments are piled on the screen mesh, a piece of nonwoven fabric can be created on the screen mesh so that a majority of filaments are aligned in the longitudinal direction of the fabric. In this way, nonwoven fabric mainly containing filaments aligned in the longitudinal direction is produced.

Japanese Patent No. 2612203 discloses a method of producing a nonwoven fabric in which fibers are blown off together with a fluid from a blowoff nozzle toward an upper surface of a running belt-conveyor, and the fibers are piled so that the fibers can be aligned in one direction on the upper surface of the belt conveyor, thus a web having fiber aligned therein can be produced. According to one example of the method of producing fabric, at least a part of the belt conveyor is bent downwardly in a direction perpendicular to the running direction thereof, and the fluid and fibers are blown off toward the bottom portion of the bent groove portion of the conveyor belt. Then, the fluid blown off from a blowoff nozzle is dispersed in the direction in which the groove of the conveyor belt extends, whereby fibers are aligned in the dispersing direction.

Japanese Patent Publication No. 6126/95 discloses a method of producing a nonwoven fabric in which a spray spinning is employed so that a plurality of filaments are aligned in substantially one direction to form a one-direction aligned nonwoven fabric. According to the method of producing fabric, when a high molecular compound is blown off through a nozzle to spin filaments, the spun filaments are rotated or vibrated in the width direction. Then, at least a pair of airflows substantially bilaterally symmetrical with respect to the side of the filaments are applied to filaments from the side of the filaments at the center of one filament rotated or vibrated, under condition that the rotated or vibrated filament has a draft property of two times or more. Thus, at least a pair of airflows are applied to filaments so that the filaments are dispersed in a direction perpendicular to the spinning direction of the filament while the filament is applied with draft. In this way, filaments are aligned in the direction in which the filaments are dispersed, and the filaments are piled in stratum, and the one-direction aligned nonwoven fabric can be produced.

The nonwoven fabric produced by the above methods has a high tensile strength. Moreover, since the filament composing the nonwoven fabric has a small diameter of 5 $\mu$m to 15 $\mu$m after subjecting it to the stretching process, its feeling of touch is smooth and the texture is flexible and soft. Furthermore, the nonwoven fabric is glossy and suitable for printing. In other words, owing to the minute filament diameter, the nonwoven fabric is proper texture. In addition, owing to high tensile strength, the nonwoven fabric provides desirable practical utility in spite of the fact that the thickness thereof is small.

Although the nonwoven fabric produced by the above-described methods disclosed in respective publications has a high tensile strength and proper texture, the productivity of the nonwoven fabric according to the above methods is still unsatisfactory. Therefore, it is necessary to improve the productivity for reducing the cost of the nonwoven fabric. For this reason, in order that the productivity of the producing apparatus disclosed in the above publications and the cost is reduced, it is necessary to develop a spinning means for spinning filaments of a transversely aligned web in which filaments are aligned in the transverse direction. Further, in addition to the improvement of productivity in spinning the filaments, it is necessary to enlarge the tensile strength of the transversely aligned web formed of the obtained filaments while the high productivity is maintained.

If the diameter of the filament of the product at the final stage is predetermined, to improve the productivity of the filaments by a single cone restrictively requires to increase the spinning rate of filaments by the single cone. According to a conventional method of spinning filaments at a high rate, as is disclosed in a reference entitled "The Newest Spinning Technology" (edited by Japanese Conference of Fiber Industry) published by High Molecular Publication Union, the limit rate of spinning is 10000 m/min. on an industrial base. When a transversely aligned web having a large width in which filaments are aligned in the transverse direction is produced, it is requested that the filaments are spun at a rate, e.g., 30000 m/min. to 100000 m/min. or more, far exceeding that rate which has been regarded as a limit so far.

However, to produce the nonwoven fabric only at a high productivity is meaningless, i.e., the produced nonwoven fabric shall have a proper characteristic. That is, it is necessary that the diameter of the filaments is small enough to make the fabric have a proper texture as a transversely aligned web. More concretely, it is necessary that the diameter of the filament soon after spinning falls within a range of from 10 $\mu$m to 30 $\mu$m, more desirably, to 25 $\mu$m. Further, if the transversely aligned web formed of filaments is stretched in the transverse direction to produce a transversely stretched web, it is ideal that the transversely stretched web has a tensile strength in the stretching direction of 132.5 mN/tex (1.5 g/d) or more. Desirably, the transversely stretched web is requested to have a tensile strength of 158.9 mN/tex (1.8 g/d) or more. More desirably, the transversely stretched web is requested to have a tensile strength of 176.6 mN/tex (2.0 g/d) or more. Further, since the transversely aligned web or the transversely stretched web is utilized as a nonwoven fabric, the spinning means is requested to produce the web which is free from a defect portion such as pilling due to breaking of filament.

SUMMARY OF THE INVENTION

Therefore, an object of the present invention is to provide a transversely aligned web in which spun filaments are aligned in the transverse direction and which makes it possible to have a high productivity rate, and hence a low production cost.

Another object of the present invention is to propose a method of producing such a transversely aligned web, an apparatus to produce the same, and a spinning head utilized in the apparatus for producing such a web.

Another object of the present invention is to provide a transversely aligned web in which the tensile strength in the transverse direction of the transversely aligned web is high and proper texture as a fabric is maintained in spite of the fact that the productivity rate for the web is high.

Still another object of the present invention is to propose a method of producing such a transversely aligned web and an apparatus for producing the same in spite of the fact that productivity for producing the web is high.

In order to attain the above object, there is provided a transversely aligned web having filaments aligned in a transverse direction, wherein the filaments are spun at a rate of 30000 m/min. or more, the filaments extend continuously from one edge to the other edge in the width direction of the transversely aligned web, and the width thereof is 300 mm or more.

According to the transversely aligned web of the present invention, the filaments forming the transversely aligned web are spun at a rate of 30000 m/min. or more, which is remarkably larger than the rate of a conventional high-rate multi-filament spinning machine, for example. Therefore, there can be obtained a transversely aligned web which makes it possible to produce at a high productivity and with a low cost. Further, according to the transversely aligned web of the present invention, the filaments composing the transversely aligned web extend continuously from one edge to the other edge in the width direction of the transversely aligned web, and the width thereof is 300 mm or more. Therefore, the transversely aligned web is suitable for use as a transversely aligned nonwoven fabric, unlike a web having a defect portion such as pilling due to breaking of filament. Moreover, since the filaments extend continuously from one edge to the other edge in the width direction of the transversely aligned web, the transversely aligned web becomes wide and has a large tensile strength and elongation in the transverse direction of the transversely aligned web in spite of the fact that the productivity rate for the web is high. Furthermore, the above transversely aligned web is suitable as an original web when the original web is stretched in the transverse direction to produce a transversely stretched nonwoven fabric.

According to the present invention, it is preferable for the filament to have a diameter of a range of from 10 $\mu$m to 30 $\mu$m, and for the transversely aligned web to have an elongation of 70% or more in the transverse direction.

With the above property, when the transversely aligned web is utilized as an original web for forming a transversely stretched nonwoven fabric, it is possible to produce a transversely stretched nonwoven fabric which has a sufficiently large width, a desired texture and flexible and soft nature.

According to the present invention, the transversely aligned web may be stretched in the transverse direction, and further, it is preferable for the filaments composing the stretched transversely aligned web to have a diameter of a range of from 5 $\mu$m to 15 $\mu$m, and the tensile strength of the stretched transversely aligned web in the stretching direction is preferably 132.5 mN/tex (1.5 g/d) or more.

As described above, the transversely aligned web stretched in the transverse direction is formed of filaments of which diameter falls in the range of from 5 $\mu$m to 15 $\mu$m, and the tensile strength of the stretched transversely aligned web in the stretching direction is 132.5 mN/tex or more. Therefore, the transversely stretched nonwoven fabric according to the present invention provides a soft feeling of touch and has a high tensile strength in the transverse direction. The transversely stretched nonwoven fabric is suitable as an original web for producing a cross laminated nonwoven fabric in which the transversely stretched nonwoven fabric is laid on a longitudinally aligned nonwoven fabric or the like so that the aligning directions of filaments of respective nonwoven fabrics cross to each other.

According to the method of producing a transversely aligned web and apparatus for producing a transversely aligned web, initially, a melted resin is extruded from a spinning nozzle having an inner diameter of 0.6 mm or more downwardly. At the open end of the spinning nozzle, there is formed a annular primary airflow nozzle having a diameter of 2.5 mm or more so as to be concentric with the opening end of the spinning nozzle, and a primary airflow is blown off at a high temperature and at a high velocity in the gravitational direction, whereby a melted filament extruded from the opening end of the spinning nozzle is vibrated. Thereafter, secondary airflows at a high temperature are blown off from secondary airflow nozzles, which are disposed on the upstream side and the downstream side of the running direction of the conveyor with respect to the melted filament, toward the extruded melted filament vibrated by the primary airflow. Thus, the secondary airflows collide with each other below the spinning nozzle.

In this way, the extruded melted filament vibrated by the primary airflow can be flowed together with the secondary airflows which collide with each other and are spread in the width direction of the conveyor. Thus, the extruded melted filament vibrated by the primary airflow can be spread by the secondary airflows, with the result that it becomes possible to spin the filaments deriving from solidifying of the extruded melted filament, at a high rate of 30000 m/min. or more.

Then, the extruded melted filament is spread in the width direction of the conveyor, whereby the spun filaments are aligned in the width direction of the conveyor and piled on the conveyor. Thus, production is carried out for producing a transversely aligned web having filaments aligned in the width direction of the conveyor and extending in one direction along the running direction of the conveyor.

According to the process of producing the transversely aligned web, since filaments can be spun at a high rate of 30000 m/min. or more, the productivity of the transversely aligned web can be improved and hence the cost of the transversely aligned web can be decreased. Moreover, it becomes possible to produce the transversely aligned web in which filaments extend from one edge to the other edge of the transversely aligned web in the width direction thereof, and it becomes possible to widen its width up to 300 mm or more.

In order to improve the productivity of the transversely aligned web, it is necessary to array a number of spinning heads above the conveyor. According to the present invention, filaments can be spun at a high rate by a single spinning head. Therefore, the necessary number of spinning heads to be arrayed above the conveyor can be reduced. Thus, with the method of and apparatus for producing a transversely aligned web according to the present invention, it becomes possible to reduce the cost of facility and floor area to be prepared for the facility. Moreover, since the necessary number of spinning heads to be arrayed above the conveyor can be reduced, it is expected that the number of heads subjected to adjustment can also be reduced. Therefore, the method of and apparatus for producing a transversely aligned web according to the present invention are advantageous in terms of adjustment and maintenance of facility. Furthermore, the method of and apparatus for producing a transversely aligned web according to the present invention can provide high productivity in producing the transversely aligned web but also a merit that a transversely aligned web acquires a large width.

In the description of the present invention above and below provided for explaining the aligning direction of the filaments of the nonwoven fabric or stretching direction of the nonwoven fabric, the term "longitudinal direction" means a direction in which the nonwoven fabric is conveyed upon producing the nonwoven fabric, and the term "transverse direction" means a direction perpendicular to the longitudinal direction, i.e., the width direction of the nonwoven fabric.

In the description of the present invention above and below, the term "elongation" is in conformity with JIS (Japanese Industrial Standard)-L1095. That is, a web of a width of 5 cm is held so as to extend over a distance of 10 cm in the longitudinal direction and stretched at a tensile velocity of 10 cm/min. Then, the rate of stretching length to its original length upon breaking the web is expressed in a manner of %.

Further, it is a custom that the tensile strength of the web or the nonwoven fabric is expressed as a breaking strength, or a breaking load per 5 cm which is determined by a long fiber filament nonwoven fabric testing method based on JIS-L1096. However, in the description of the present invention above and below, since the mass per area of the nonwoven fabric under test is variously selected, the mass of the nonwoven fabric is converted into denier (tex) and the tensile strength is expressed by a strength per unit tex (mN/tex). A strength per unit denier (d) is denoted as a reference in addition to the strength per unit tex (mN/tex).

The above and other objects, features and advantages of the present invention will become apparent from the following description with reference to the accompanying drawings which illustrate examples of the present invention.

BRIEF DESCRIPTION OF THE DRAWINGS

FIG. 7 is a table in which are listed materials of the melted resin, spinning conditions and experimental results of experimental examples 1 to 4 (Examples 1–4) and comparable examples 1 to 5;

FIG. 8 is a table in which are listed dimensions of respective parts of the spinning head utilized for producing the experimental examples 1 to 4 (Examples 1–4) and comparable examples 1 to 5 shown in FIG. 7;

DETAILED DESCRIPTION OF THE PREFERRED EMBODIMENTS

Figure 1A:
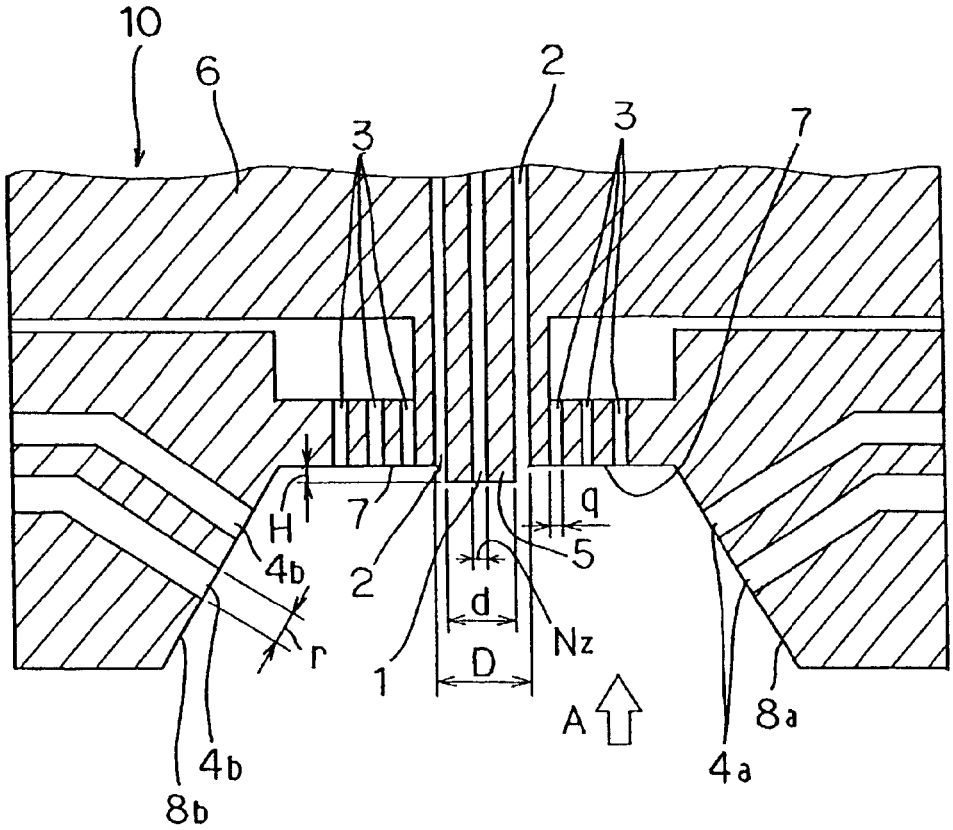
FIG. 1A is a diagram showing a cross-section of a spinning head taken along the center line of a spinning nozzle formed in the spinning head which is provided in a producing apparatus for producing a transversely aligned web according to one embodiment of the present invention.
Figure 1B:
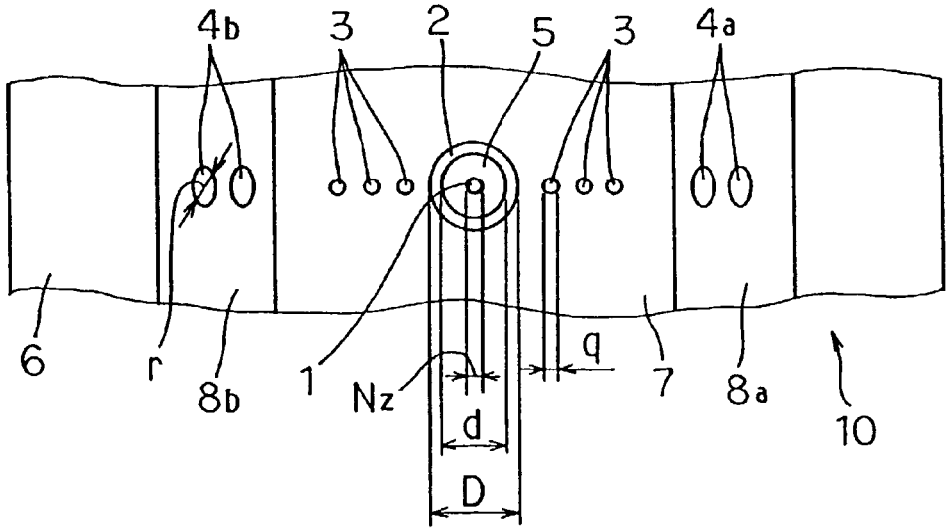
FIG. 1B is a diagram showing a configuration of the spinning head shown in FIG. 1A as viewed from the direction indicated by A in FIG. 1A, or the lower side thereof.

FIGS. 1A and 1B show an apparatus for producing a transversely aligned web according to a first embodiment of the present invention which includes a mesh belt running in one direction and a spinning unit having a spinning head disposed above the mesh belt. According to the apparatus for producing a transversely aligned web, filaments are spun at a high rate by the spinning unit. The spun filaments are piled on the mesh belt so that the filaments are aligned in the width direction of the mesh belt. In this way, there is produced a transversely aligned web in which most of the filaments are oriented in the same direction.

As shown in FIGS. 1A and 1B, spinning head 10 provided in the apparatus for producing the transversely aligned web of the present embodiment includes air blowoff unit 6, spinning nozzle part 5 of a cylindrical shape disposed within air blowoff unit 6. Spinning nozzle part 5 has spinning nozzle 1 formed so as to extend in one direction and open at least one end of spinning nozzle part 5. Spinning nozzle 1 has an inner diameter of $N_z$ at the open end thereof. Spinning head 10 is attached to the spinning unit so that the longitudinal direction of spinning nozzle 1 under operation is in parallel with the gravitational direction. Spinning nozzle 1 is supplied with a melted polymer as a melted resin from the upper side thereof. The supplied melted polymer flows through spinning nozzle 1 and is extruded from the opening end at the lower side of spinning nozzle 1 downwardly.

On the other hand, air blowoff unit 6 has a concave portion formed so that a pair of slant surfaces 8*a* and 8*b* are formed. The bottom of the concave portion of air blowoff unit 6 is horizontal plane 7 which is perpendicular to the gravitational direction when the head is under operation. Thus, one slant surface 8*a* is disposed on one side of horizontal plane 7 and the other slant surface 8*b* is disposed on the other side of horizontal plane 7. Further, the pair of slant surfaces 8*a* and 8*b* are formed to be symmetrical with each other with respect to a plane perpendicular to horizontal plane 7 and containing the center line of spinning nozzle 1. Furthermore, the pair of slant surfaces 8*a* and 8*b* are obliquely formed such that the horizontal distance between the pair of slant surfaces 8*a* and 8*b* becomes greater as the level at which the distance is taken is lowered.

Spinning nozzle part 5 is exposed at the lower end portion thereof to the outside of spinning head 10 at the center portion of horizontal plane 7 of air blowoff unit 6. Spinning nozzle part 5 is provided within the air blowoff unit so that a annular gap is provided between the outer surface of spinning nozzle 5 and the inner surface of air blowoff unit 6. This annular gap serves as primary airflow nozzle 2 from which heated air is blown off as a primary airflow. The outer diameter of spinning nozzle 5, i.e., the inner diameter of primary airflow nozzle 2 is d, while the outer diameter of primary airflow nozzle 2 is D. Spinning nozzle part 5 is attached to air blowoff unit 6 so that spinning nozzle part 5 projects at the end thereof by a height H from the end portion of primary airflow nozzle 2 of air blowoff unit 6, or horizontal plane 7, as shown in FIG. 1A.

A primary airflow is supplied from the upper portion of primary airflow nozzle 2 into primary airflow nozzle 2. The supplied primary airflow passes through primary airflow nozzle 2 to the outside from the opening end of primary airflow 2 at horizontal plane 7 downwardly at a high speed. As described above, the primary airflow is blown off at a high speed from primary airflow nozzle 2, whereby an air-pressure decreased region in which air pressure is decreased is caused below spinning nozzle part 5. Owing to the air-pressure decreased region, the melted polymer extruded from spinning nozzle 1 is vibrated. The level distance, H between the lower surface of spinning nozzle part 5 and horizontal plane 7 which is a blowoff surface of the primary airflow from primary airflow nozzle 2, serves as a setup distance of spinning nozzle part 5 in the axial direction.

The diameter $N_z$ of spinning nozzle 1 is of a range from 0.60 mm to 0.85 mm or more. The outer diameter of spinning nozzle part 5, or the inner diameter d of annular primary airflow nozzle 2 from which primary airflow is blown off, is of a range from 2.5 mm to 6.0 mm. With these dimensions, the primary airflow at a high temperature is blown off from annular primary airflow nozzle 2 formed so as to surround spinning nozzle 1. In this way, the primary airflow can be flowed in the gravitational direction through the whole periphery of the diameter of 2.5 mm or more of primary airflow nozzle 2 which is concentric with the center line extending in the longitudinal direction of spinning nozzle 1 from the opening end of primary airflow nozzle 2.

Further, air blowoff unit 6 has a plurality of secondary airflow nozzles 4*a* and 4*b* from which a heated secondary airflow is blown off. Owing to the secondary airflows blown off from secondary airflow nozzles 4*a* and 4*b*, the melted polymer vibrated by the primary airflow blown off from primary airflow nozzle 2, can be spread and dropped. Then, filaments deriving from the melted polymer can be aligned in one direction, as will be described later on. Secondary airflow nozzle 4*a* is formed so as to open on slant surface 8*a* while secondary airflow nozzle 4*b* is formed so as to open on slant surface 8*b*. Each of secondary airflow nozzles 4*a* and 4*b* has the same cross-section, or a circular shape, which is taken along the direction perpendicular to the longitudinal direction of the nozzle. The diameter of the circular shaped cross-section is r. Secondary airflow nozzle 4*a* extends into air blowoff unit 6 so that the extending direction thereof is perpendicular to slant surface 8*a*. Similarly, secondary airflow nozzle 4*b* extends into air blowoff unit 6 so that the extending direction thereof is perpendicular to slant surface 8*b*.

The plurality of secondary airflow nozzles 4*a* and the plurality of secondary airflow nozzles 4*b* are arrayed so that each center line of all the plurality of secondary airflow nozzles 4*a* and the plurality of secondary airflow nozzles 4*b* and the center line of spinning nozzle 1 are included in a plane which is perpendicular to horizontal plane 7 and slant surfaces 8*a* and 8*b*. Thus, the plurality of secondary airflow nozzles 4*a* and the plurality of secondary airflow nozzles 4*b* are disposed in a symmetric manner with respect to the midst plane between slant surfaces 8*a* and 8*b*, i.e., a plane which contains the center line of spinning nozzle 1 and is perpendicular to horizontal plane 7.

While in the above embodiment of the present invention two pairs of secondary airflow nozzles 4*a* and 4*b* are formed, a single pair of primary airflow nozzles 4*a* and 4*b* may be provided on slant surfaces 8*a* and 8*b*, respectively. That is, only one pair of secondary airflow nozzles 4*a* and 4*b* may be formed. However, it is preferable that two or more pairs of secondary airflow nozzles 4*a* and 4*b* are provided.

In the arrangement of spinning head 10, secondary airflow is blown off from each of secondary airflow nozzles 4*a* and 4*b* in a direction obliquely downward relative to the horizontal direction. Thus, a secondary airflow blown off from secondary airflow nozzle 4*a* and a secondary airflow blown off from secondary airflow nozzle 4*b* are directed to both the sides of the melted polymer extruded from spinning nozzle 1 and collide with each other below spinning nozzle 1. When the secondary airflow blown off from secondary airflow nozzle 4*a* and the secondary airflow blown off from secondary airflow nozzle 4*b* collide with each other below spinning nozzle 1, a part of the secondary airflow colliding with each other spreads in a direction which is perpendicular to the plane containing the center lines of secondary airflow nozzles 4*a* and 4*b* and spinning nozzle 1 and parallel with horizontal plane 7. The melted polymer extruded from spinning nozzle 1 is drifted by the spreading secondary airflow. The melted polymer drifted by the spreading secondary airflow is also spread from side to side with respect to the center line which is extended from the center line of spinning nozzle 1 as viewed from slant surface 8*a* or 8*b* side toward spinning nozzle 1.

Also, a plurality of small apertures 3 are formed at the vicinity of spinning nozzle part 5 on horizontal plane 7 of air blowoff unit 6. Each of small apertures 3 extends in a direction perpendicular to the horizontal direction of spinning nozzle 1, or horizontal plane 7. The cross-section of each small aperture 3 taken along a line perpendicular to the longitudinal direction of the aperture, is a circular shape and its diameter is constantly q. These small apertures 3 are arrayed in a line perpendicular to the center line of spinning nozzle 1 on each side of secondary airflow nozzle 4*a*, 4*b* of spinning nozzle part 5. The number of small apertures 3 provided on the side of secondary airflow nozzle 4*a* of spinning nozzle part 5 is the same as the number of small apertures 3 provided on the side of secondary airflow nozzle 4*b* of spinning nozzle part 5. Further, similarly to secondary airflow nozzles 4*a* and 4*b*, the small apertures 3 are arrayed in a symmetrical manner with respect to a plane of the midst point between slant surfaces 8*a* and 8*b*, or a plane containing the center line of spinning nozzle 1 and perpendicular to horizontal plane 7.

According to the above-described embodiment of the present invention, there are three small apertures 3 provided between spinning nozzle part 5 and one surface 8*a*. Also, there are three small apertures 3 provided between spinning nozzle part 5 and other surface 8*b*. A heated airflow is blown off from the opening end of each small aperture 3 on the side of horizontal plane 7, whereby filaments can be spun with stability. The heated airflow blown off from each small aperture 3 may be led from a heating source of the primary airflow for blowing off an airflow from primary airflow nozzle 2. Further, the heated airflow supplied to small apertures 3 may be led from a heating source of the secondary airflow for blowing off an airflow from secondary airflow nozzles 4*a* and 4*b*. Alternatively, a third heating source which is separate from that of the primary airflow or secondary airflow, may be prepared and airflow from the third heating source may be blown off from small apertures 3.

Figure 2A:
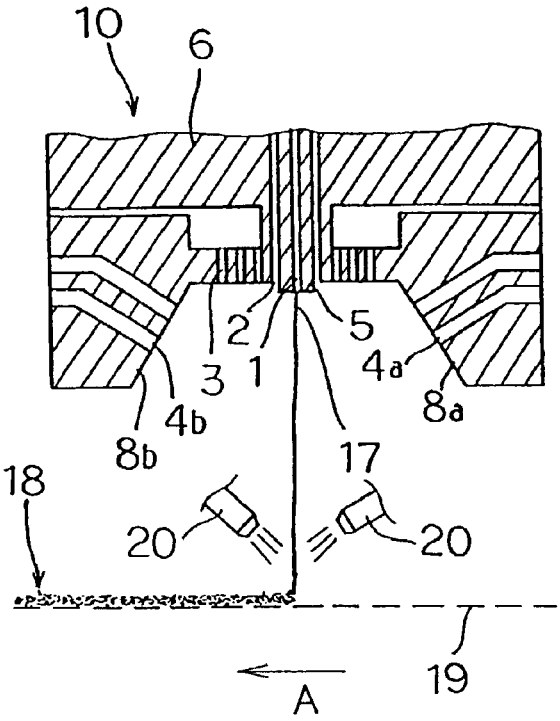
FIG. 2A is a diagram for explaining how a spinning apparatus equipped with the spinning head shown in FIGS. 1A and 1B is driven for producing the nonwoven fabric, the diagram showing the spinning apparatus as viewed from a direction perpendicular to the running direction of a mesh belt provided in the spinning apparatus.
Figure 2B:
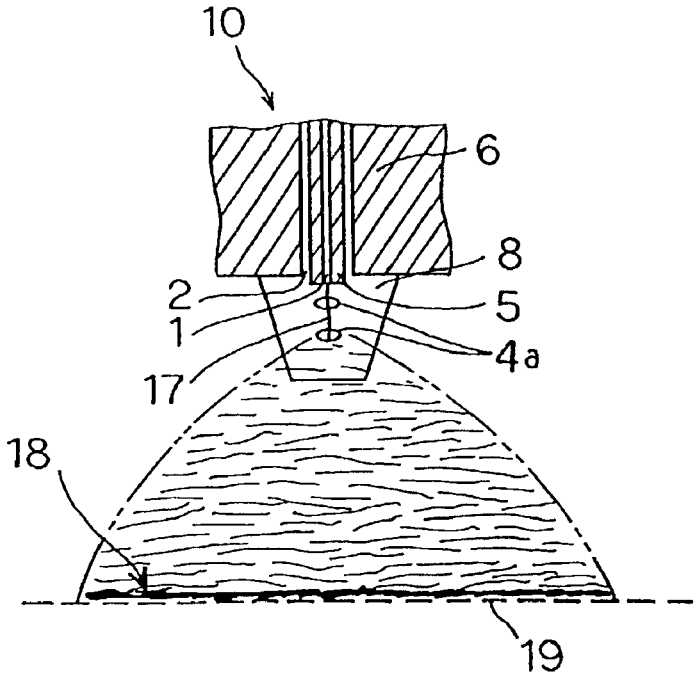
FIG. 2B is a diagram for explaining how the spinning apparatus equipped with the spinning head shown in FIGS. 1A and 1B is driven for producing the nonwoven fabric, the diagram showing the spinning apparatus as viewed from the downstream side of the running direction of a mesh belt provided in the spinning apparatus.

FIGS. 2A and 2B are diagrams each showing how nonwoven fabric is produced by the apparatus of a transversely aligned web of the present embodiment including the spinning unit having spinning head 10 shown in FIGS. 1A and 1B.

As shown in FIGS. 2A and 2B, the apparatus for producing the transversely aligned web of the present embodiment includes mesh belt 19 of a belt-shape as a conveyor belt. Filaments are piled on mesh belt 19, whereby nonwoven fabric can be produced. The produced nonwoven fabric is conveyed by mesh belt 19. At least a part of mesh belt 19 runs in one direction indicated by an arrow A of FIG. 2A in a horizontal plane below spinning head 10.

Spinning head 10 is fixed to a frame not shown so that spinning nozzle 1 is disposed above the substantial center portion of mesh belt 19 in width direction. Further, spinning nozzle 1, small apertures 3, secondary airflow blowoff nozzles 4*a* and 4*b* are disposed so that each center line of these components is included in a plane which is in parallel with the running direction of mesh belt 19 and perpendicular to the surface of mesh belt 19. That is, spinning nozzle 1 and the plurality of small apertures 3 are arrayed along the running direction of mesh belt 19. The plurality of secondary airflow nozzles 4*a* are disposed on the upstream side of spinning nozzle part 5 in the running direction of mesh belt 19 while the plurality of secondary airflow nozzles 4*b* are disposed on the downstream side of spinning nozzle part 5 in the running direction of mesh belt 19. Thus, secondary airflow blowoff nozzles 4*a* and 4*b* are disposed so as to be included in a plane. The plane contains the center line of spinning nozzle 1, is in parallel with the running direction of mesh belt 19, and is perpendicular to the surface of mesh belt 19, symmetrically along the running direction of mesh belt 19 with respect to the center line of spinning nozzle 1.

Further, the apparatus for producing transversely aligned web according to the present embodiment includes a plurality of cooling nozzles 20 as cooling means. Cooling nozzles 20 are disposed above mesh belt 19 on the upstream side and downstream side of the running direction of mesh belt 19 so as to cool melted polymer 17 extruded from spinning nozzle 1. Airflow containing a mist-like moisture is blown off from each cooling nozzle 20. Airflow containing a mist-like moisture blown off from each cooling nozzle 20 is injected toward melted polymer 17 before melted polymer 17 from spinning nozzle 1 reaches mesh belt 19, whereby melted polymer 17 can be cooled. While in the mode of the present embodiment cooling nozzles 20 are disposed on both the sides of melted polymer 17, cooling nozzle 20 may be provided on only one of the upstream side and the downstream side of the mesh belt.

As described above, spinning head 10 is made up with various components such as the spinning nozzle part, the primary airflow blowoff unit, the secondary airflow blowoff unit and so on. When the spinning head is constructed, these components may be independently manufactured and then these components are assembled to construct the spinning head. The process of assembling the spinning head is important in terms of establishing precise determination of the dimensions of each components of spinning head 10 and the optimum assemblage thereof. However, according to the spinning head of the present invention, the important matter is mechanical accuracy of alignment of respective components after assemblage. If each component of the spinning head is manufactured independently and thereafter they are assembled into the spinning head, it is difficult to establish the mechanical alignment among these components. Therefore, these components may be worked in an integrally combined state. Alternatively, these components are assembled so as to establish mechanical alignment and then weld work is effected thereon under condition that the alignment is fixed. Thus, some trial manufacture revealed that spinning head 10 with a stable alignment can be obtained by the above method of manufacturing.

Spinning head 10 manufactured in the above-described method is supplied with a primary airflow to be blown off from the primary airflow nozzle 2. When spinning head 10 is driven, it is necessary for the primary airflow to be supplied to primary airflow nozzle 2 uniformly. The term "uniform" means that the heated airflow blown off from primary airflow nozzle 2 is uniform in terms of not only velocity but also the temperature thereof.

Figure 3:
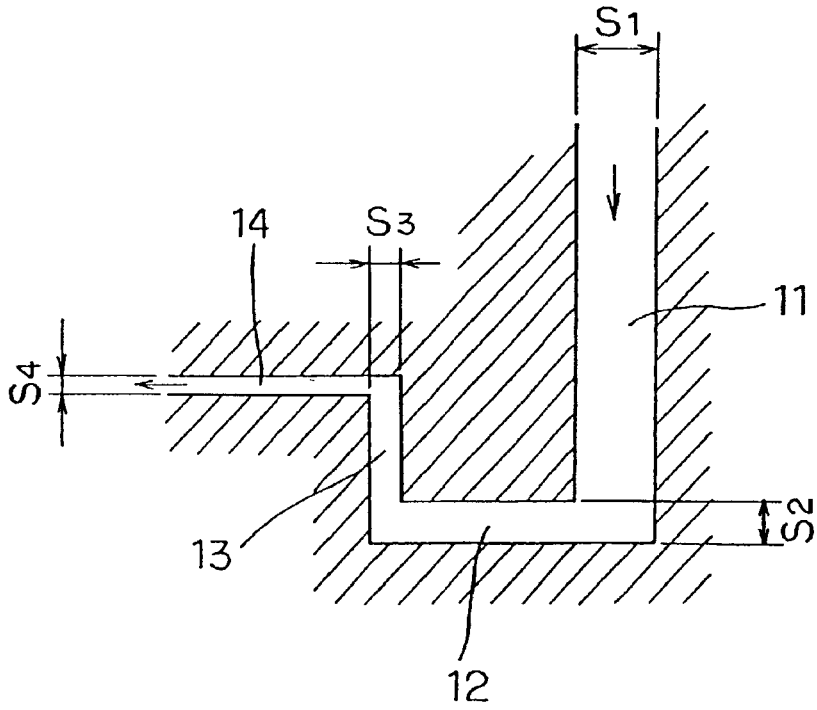
FIG. 3 is a diagram showing a cross-section of one example of a flow passage provided within the spinning head shown in FIGS. 1A, 1B, 2A and 2B for making a heated airflow blown off from a primary airflow nozzle a uniform airflow.

FIG. 3 is a diagram showing an example of flow passage provided within spinning head 10 and communicated with primary airflow nozzle 2. As shown in FIG. 3, the flow passage is formed of annular gaps 11 to 14. Each of annular gaps 11 to 14 is formed into an annular shape concentric with respect to the center line of spinning nozzle 1 within the upper portion of the nozzle head relative to primary airflow nozzle 2 of air blowoff unit 6. Annular gap 11 extends in the gravitational direction so that the width of the gap is maintained at constant value, $S_1$. Thus, a heated airflow can be flowed downwardly through annular gap 11. Annular gap 11 communicates at its lower portion with annular gap 12 which extends from the lower portion of annular gap 11 toward the center line of spinning nozzle 1 so that the gap extends on a horizontal plane toward the inside of annular gap 11. The dimension of the gap of annular gap 12 is $S_2$ and the value is constant. A heated airflow supplied from annular gap 11 is flowed inwardly within annular gap 12 toward the center line of spinning nozzle Annular gap 12 communicates at its inner portion with annular gap 13 at its lower portion which extends in the gravitational direction inside annular gap 11. The dimension of the gap of annular gap 13 is $S_3$ and the value is constant. Annular gap 13 communicates at its upper end with annular gap 14 which extends inwardly from the upper end of annular gap 13 toward the center line of spinning nozzle 1. The dimension of the gap of annular gap 14 is $S_4$ and the value is constant. The heated airflow supplied from annular gap 13 is flowed inwardly within annular gap 14 toward the center line of spinning nozzle 1.

The dimensions of the gaps $S_1$ to $S_4$ of annular gaps 11 to 14 are determined in such a manner that at least one of the dimensions of the gaps of annular gaps 11 to 14 falls within a range of from 0.1 mm to 0.5 mm. In this way, when the heated airflow passes through the flow passage formed of annular gaps 11 to 14, the velocity and the temperature of the heated airflow become uniform, with the result that uniform heated airflow can be created.

In spinning nozzle 10 having the above-illustrated flow passage formed therein, a heated airflow as a primary airflow is supplied to spinning head 10 and led to annular gap 11 from the upper portion thereof. The heated-airflow led to annular gap 11 is made into a uniform flow when the heated flow passes through annular gaps 11, 12 13 and 14 sequentially. The heated airflow led to annular gap 14 is led from the inside portion of annular gap 14 to the upper portion of primary airflow nozzle 2 which is located at the center on the inner side of annular gap 14. In this way, the heated airflow made into a uniform flow in terms of velocity and temperature is supplied to the inner space of primary airflow nozzle 2, and hence it becomes possible to blow off a heated airflow made into a uniform flow in terms of velocity and temperature thereof.

While in the present embodiment the above-described arrangement of flow passage is applied to the flow passage for blowing off a heated airflow from primary airflow nozzle 2, the same or similar arrangement of the flow passage may be applied to a flow passage for blowing off an airflow from secondary airflow nozzles 4*a* and 4*b* and small apertures 3. With this arrangement, it becomes possible to blow off a uniform heated airflow from each of secondary airflow nozzles 4*a* and 4*b* and small apertures 3.

The processes for producing the transversely aligned web by using the producing apparatus constructed as described above will hereinafter be described with reference to FIGS. 2, 10A, 10B, 11A and 11B.

Initially, melted polymer is supplied from the upper portion of spinning nozzle part 5 into spinning nozzle 1. Thus, melted polymer 17 stored in spinning nozzle 1 is extruded from the opening end of spinning nozzle 1 at the lower end thereof toward the upper surface of mesh belt 19. In this case, since a primary airflow at a high temperature is blown off downwardly from primary airflow nozzle 2, an air-pressure decreased region is created below spinning nozzle part 5 owing to the heated airflow. Owing to the air-pressure decreased region, melted polymer extruded from spinning nozzle 1 is vibrated. Thus, melted polymer 17 is dropped downwardly owing to gravity while vibrated by the primary airflow blown off from primary airflow nozzle 2.

Figure 11A:
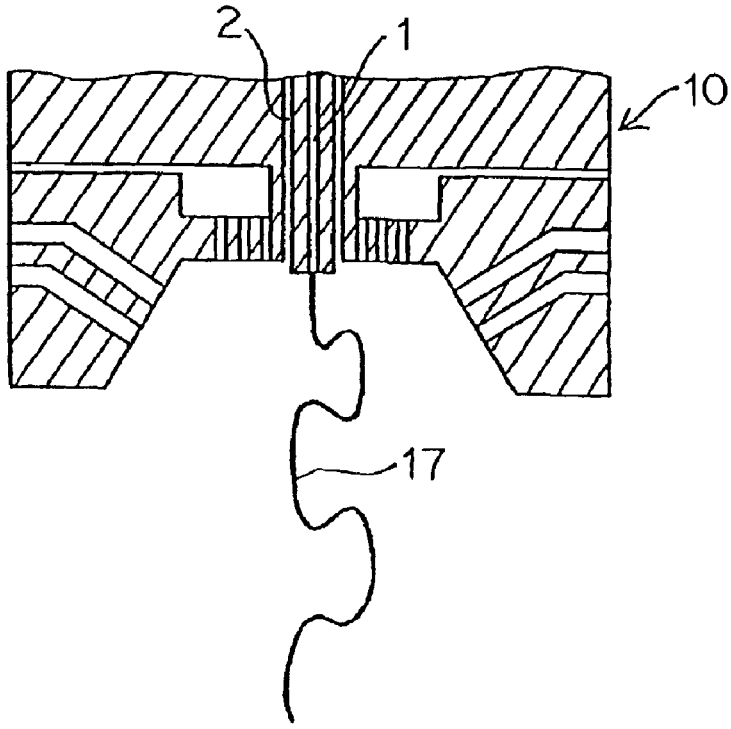
FIG. 11A is a diagram showing a cross-section of the spinning head as viewed from a direction perpendicular to the running direction of the mesh belt and the melted polymer extruded from the spinning head, to which reference is made for explaining that the extruded melted polymer vibrated by a primary airflow and dropping downwardly, is spread in the width direction of the mesh belt by a secondary airflow.
Figure 11B:
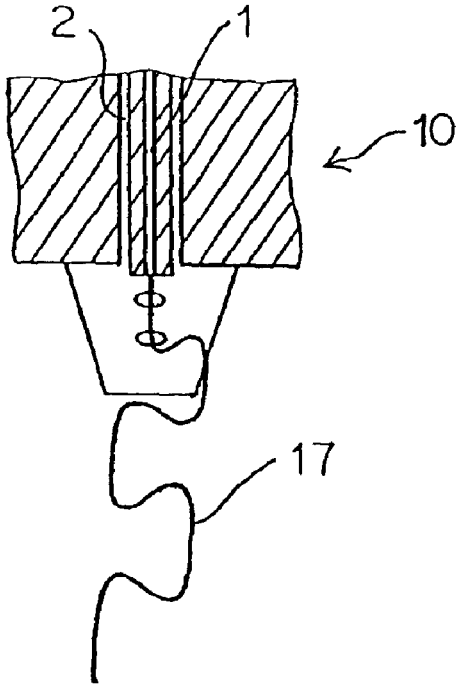
FIG. 11B is a diagram showing a cross-section of the spinning head as viewed from the downstream side of the running direction of the mesh belt and the melted polymer extruded from the spinning head, to which reference is made for explaining that the extruded melted polymer vibrated by the primary airflow and dropping downwardly, is spread in the width direction of the mesh belt by the secondary airflow.

FIGS. 11A and 11B are diagrams illustrative of the phenomenon in which the melted polymer extruded from spinning nozzle is vibrated owing to the air-pressure decreased region created below spinning nozzle part 5 by the primary airflow blown off from primary airflow nozzle 2. The vibration mode of extruded melted polymer 17 contains several vibration components such as a vibration in a plurality of directions perpendicular to the gravitational direction and a vibration in the up-and-down direction. Therefore, melted polymer 17 vibrates in such a manner that the vibration contains irregular swingable motions in a variety of directions perpendicular to the gravitational direction and an irregular swingable motion in the up-and-down direction.

Further, as described above, below spinning nozzle 1, collision is created between the secondary airflow at a high temperature blown off from secondary airflow nozzle 4*a* disposed on the upstream side of the running direction of mesh belt 19 and the secondary airflow at a high temperature blown off from secondary airflow nozzle 4*b* disposed on the downstream side of the running direction of mesh belt 19. Thus, both of the secondary airflows blown off from secondary airflow nozzles 4*a* and 4*b* which are provided on the upstream side and downstream side of the running direction of mesh belt 19, collide with each other on vibrated and dropped melted polymer 17. Owing to the collision of the airflows, a part of respective secondary airflows colliding with each other spreads in the width direction of mesh belt 19. Vibrated and dropped melted polymer 17 is drifted by the secondary airflow which is spread in the width direction of mesh belt 19, whereby melted polymer 17 is also spread in the width direction of mesh belt 19, as shown in FIG. 2B.

FIGS. 11A and 11B are diagrams illustrative of a phenomenon in which melted polymer 17 vibrated by the primary airflow and dropped is spread in the width direction of mesh belt 19. As shown in FIG. 11B, the irregular vibration caused by the primary airflow on melted polymer 17 is amplified in the width direction of mesh belt 19 and up-and-down direction. During the amplification of the vibration, melted polymer 17 is further spread in the width direction of mesh belt 19 by the spreading secondary airflow. With the spread of the amplitude of vibration of melted polymer 17 in the width direction of mesh belt 19, as shown in FIG. 11A, the amplitude of vibration of melted polymer 17 is slightly increased in the running direction of mesh belt 19.

When melted polymer 17 is spread in the width direction of mesh belt 19 by the secondary airflow and dropped downwardly, melted polymer 17 is cooled by the air containing a mist-like moisture, blown off from each cooling nozzle 20. Thus, melted polymer 17 is cooled rapidly, with the result that melted polymer 17 is solidified to be made into filaments. The resulting filaments are aligned in the width direction of mesh belt 19 and piled on mesh belt 19. As described above, melted polymer 17 is extruded and filaments spun from the polymer are piled on mesh belt 19 so as to be aligned in the width direction of mesh belt 19. Thus, there is produced nonwoven fabric 18 of a strip-like shape as a transversely aligned web which is made of filaments piled on mesh belt 19 and extending in the running direction of mesh belt 19.

In the above-described processes, melted polymer 17 extruded from spinning nozzle 1 is vibrated by the primary airflow blown off from primary airflow nozzle 2, and thereafter melted polymer 17 extruded from spinning nozzle 1 is spread in the width direction of mesh belt 19 by the secondary airflows blown off from secondary airflow nozzles 4*a* and 4*b*. Thus, filaments deriving from extruded melted polymer 17 can be spun at a high spinning rate of 30000 m/min. or more. The filaments spun at the high spinning rate are piled on mesh belt 19 to produce nonwoven fabric 18, whereby the transversely aligned web can be produced at a high productivity and a low cost. Further, it becomes possible to produce nonwoven fabric 18 of which width is 300 mm or more and of which elongation in the transverse direction is 70% or more, depending on the dimensions of respective parts of spinning head 10 or the various spinning conditions. Furthermore, the filaments composing nonwoven fabric 18 can be made to have a diameter of a range of from 10 $\mu$m to 30 $\mu$m depending on the dimensions of respective parts of spinning head 10 or the various spinning conditions.

The filaments composing nonwoven fabric 18 extend continuously from one edge to the other edge in the width direction of nonwoven fabric formed into the strip shape. If the width of nonwoven fabric 18 is 300 mm or more, nonwoven fabric 18 becomes suitable for use as a transversely aligned nonwoven fabric, unlike a web having a defect portion formed due to breaking of filament such as a pilling portion. Moreover, since the filaments extend continuously from one edge to the other edge in the width direction of nonwoven fabric 18, it becomes possible to obtain a resulting transversely aligned web having a large tensile strength in the transverse direction and a large width while maintaining a high productivity.

Further, nonwoven fabric 18 described above can serve as an original web to be stretched in the transverse direction to produce a transversely stretched nonwoven fabric. As described above, if the filaments forming nonwoven fabric 18 are made to have a diameter of 10 $\mu$m to 30 $\mu$m, when nonwoven fabric 18 is stretched in the transverse direction, the stretched filaments can be made to have a diameter of 5 $\mu$m to 15 $\mu$m. The nonwoven fabric formed of such filaments having the diameter of 5 $\mu$m to 15 $\mu$m becomes transversely stretched nonwoven fabric with a wide width which has a preferable texture as a cloth and soft nature. Further, such transversely stretched nonwoven fabric is a suitable original web for producing a cross laminated nonwoven fabric in which the transversely stretched nonwoven fabric is laid on a longitudinally aligned nonwoven fabric or the like so that aligned directions of filaments of the fabrics cross to each other.

If it is requested to improve the productivity of the transversely aligned web, it is necessary to increase the number of spinning heads arrayed above the conveyor. However, according to the method of producing the transversely aligned web and the apparatus for producing the same, it becomes possible to spin filaments by a single spinning head at a high rate. Therefore, the number of spinning heads to be arrayed can be reduced. Thus, the method of producing the transversely aligned web and the apparatus for producing the same according to the present invention are advantageous in terms of cost of facility and areas of facility. Furthermore, since the number of spinning heads to be arrayed is small, the number of spinning heads to be adjusted is also small. Therefore, the method of producing the transversely aligned web and the apparatus for producing the same according to the present invention are advantageous in terms of adjustment and maintenance of facility.

Figure 4A:
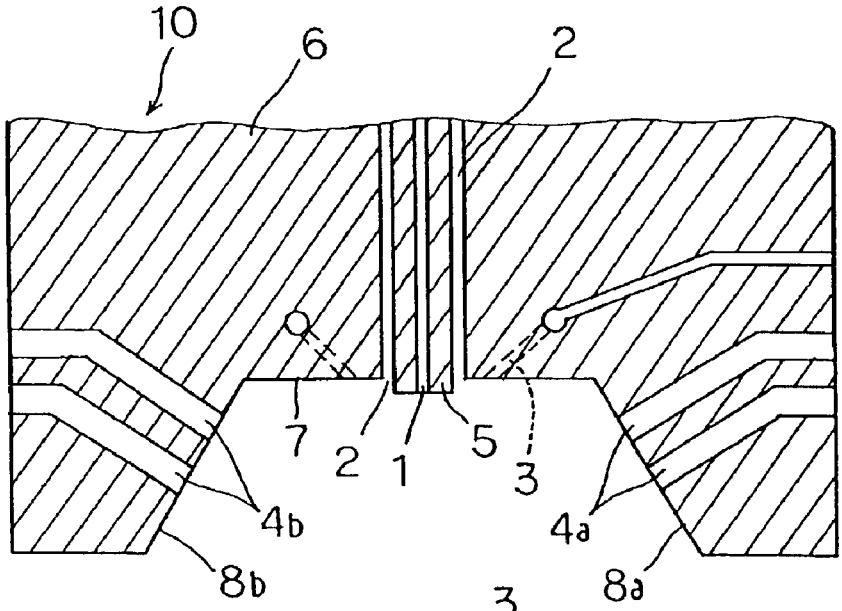
FIG. 4A is a diagram showing a cross-section of the spinning head shown in FIGS. 1A and 1B taken along the center line of the spinning nozzle and secondary airflow nozzles, wherein illustrated is an arrangement of small apertures for blowing off the heated airflow disposed around the primary airflow nozzle provided on the undersurface of the spinning head.
Figure 4B:
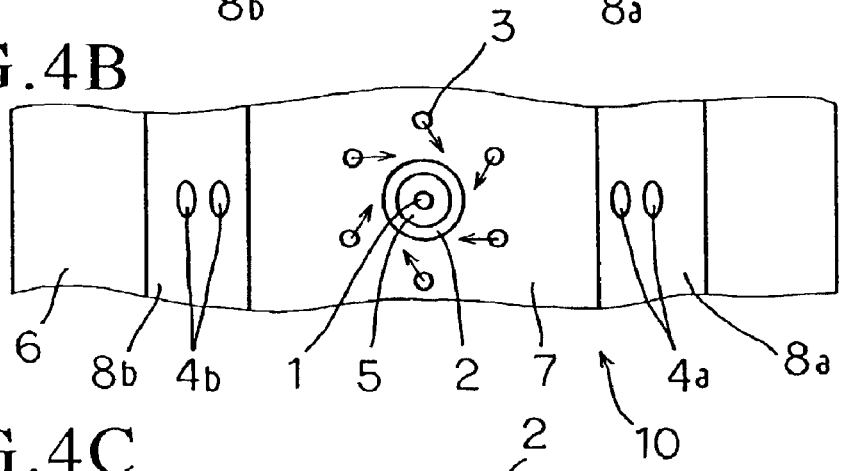
FIG. 4B is a diagram showing a plan view of the undersurface of the spinning head shown in FIGS. 1A and 1B, wherein illustrated is the arrangement of small apertures for blowing off the heated airflow disposed around the primary airflow nozzle provided on the undersurface of the spinning head.
Figure 4C:
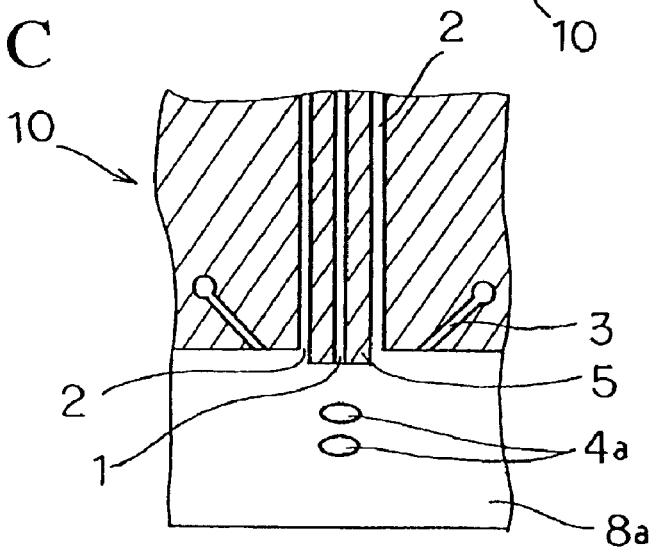
FIG. 4C is a diagram showing a cross-section of a part of the spinning head shown in FIG. 4A taken along a plane perpendicular to the plane of FIG. 4A, wherein illustrated is the arrangement of the small apertures for blowing off the heated airflow disposed around the primary airflow nozzle provided on the undersurface of the spinning head.

FIGS. 4A to 4C are diagrams showing a first modification of the embodiment of the present invention. According to the modification, the plurality of small apertures 3 are provided in air blowoff unit 6 so that their openings are arrayed at a regular interval on a circumference concentric with spinning nozzle 1, the circumference surrounding primary airflow nozzle 2 on horizontal plane 7 of air blowoff unit 6. Each of small apertures 3 is provided in a slightly oblique direction with respect to horizontal plane 7, and hence the depth direction of small aperture, i.e., the center line of small aperture 3 is tilted with respect to horizontal plane 7. Spinning of filament will be carried out with stability even by a heated airflow blown off from small apertures 3 arranged as illustrated above.

Figure 5:
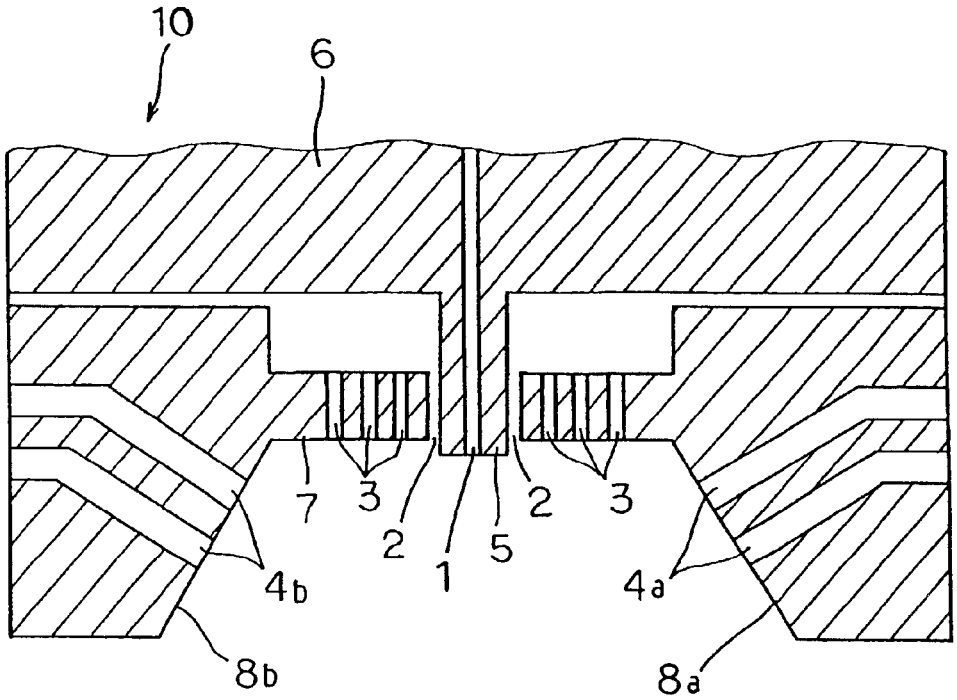
FIG. 5 is a diagram showing a cross-section of one modification of the flow passage for supplying the heated airflow provided within the spinning head shown in FIGS. 1A and 1B.

FIG. 5 is a diagram showing another modification of the embodiment of the present invention. As shown in FIG. 5, primary airflow nozzle 2 may communicate with respective small apertures 3 within spinning head 10. According to the configuration of spinning head 10, the heated airflow blown off from primary airflow nozzle 2 and the heated airflow blown off from respective small apertures 3 share the same heating source. The flow passage within spinning head 10 may take any arrangement so long as a heated airflow having a uniform velocity and temperature can be blown off from primary airflow nozzle 2.

Figure 6A:
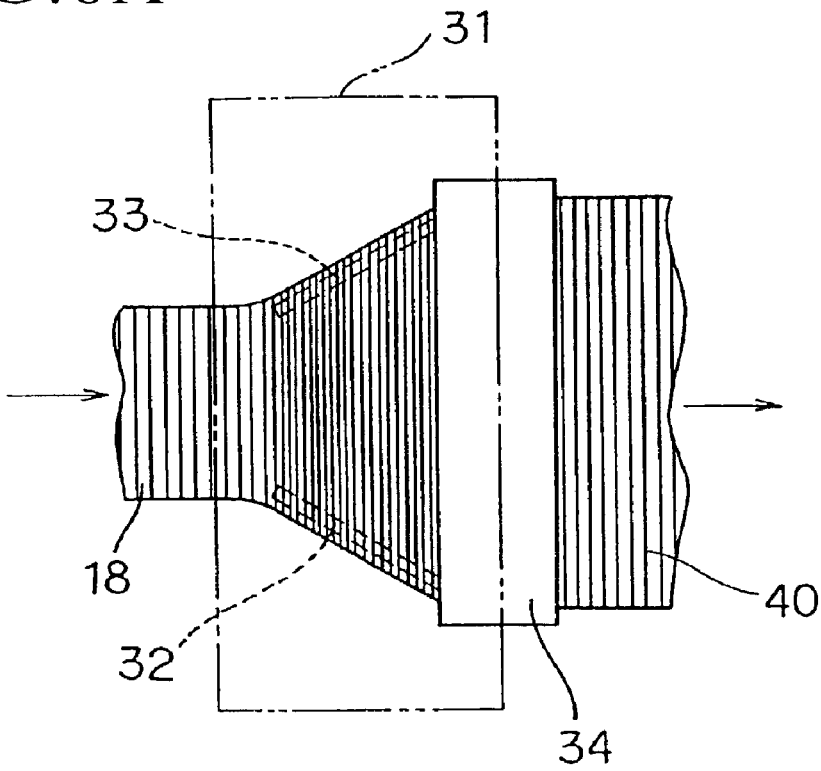
FIG. 6A is a plan view showing one example of an apparatus for stretching in the transverse direction a belt-like nonwoven fabric produced by the apparatus illustrated in FIGS. 2A and 2B.
Figure 6B:
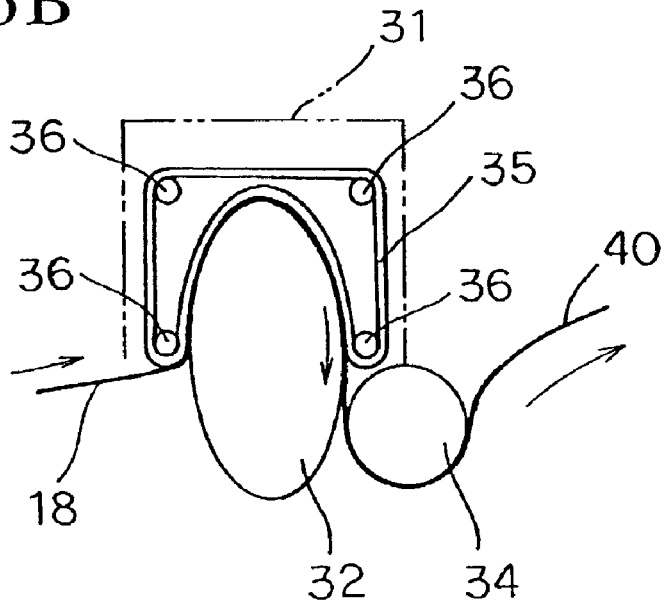
FIG. 6B is a side view showing one example of an apparatus for stretching in the transverse direction a belt-like nonwoven fabric produced by the apparatus illustrated in FIGS. 2A and 2B.

FIGS. 6A and 6B are diagrams showing one example of an apparatus for stretching nonwoven fabric of a strip shape in its transverse direction which is produced by the producing apparatus which was described with reference to FIGS. 2A and 2B. The apparatus shown in FIGS. 6A and 6B is a transversely stretching apparatus for stretching nonwoven fabric of a strip shape in its transverse direction by using a pair of pulleys.

The apparatus shown in FIGS. 6A and 6B includes heated air chamber 31 in which a heated airflow is circulated, a pair of stretching pulleys 32 and 33 provided on the right and left sides within heated air chamber 31, a pair of belt 35 provided within heated air chamber 31, cooling cylinder 34 for cooling nonwoven fabric 18 stretched within heated air chamber 31, and so on. A pair of stretching pulleys 32 and 33 provided on the right and left sides are rotated at the same circumferential speed, and disposed symmetrically with respect to the center line of the fabric stream line so that a divergent locus is formed, i.e., the distance between the circumferences of stretching pulleys 32 and 33 is widened as the position under the measurement of the distance moves from the upstream to the downstream of the running direction of nonwoven fabric 18.

The pair of stretching pulleys 32 and 33 have a belt groove formed on the circumference thereof, whereby circulating belt 35 is engaged at the part thereof with the belt groove of the pair of stretching pulleys 32 and 33. Circulating belt 35 is stretched among four rollers 36. Circulating belt 35 is not illustrated in FIG. 6A. Circulating belt 35 is engaged with the pair of stretching pulleys 32 and 33 in such a manner that a part of circulating belt 35 passes on the locus of the outer periphery of the pair of stretching pulleys 32 and 33 on the divergent locus formed by the pair of stretching pulleys 32 and 33.

According to the above-described transversely stretching apparatus, nonwoven fabric 18 made of un-oriented filaments is conveyed into heated air chamber 31. Conveyed nonwoven fabric 18 is introduced at a portion where the distance between the pair of stretching pulleys 32 and 33 becomes shortest. Nonwoven fabric 18 led by stretching pulleys 32 and 33 is held at its one edge in the transverse direction by the periphery of stretching pulley 32 and circulating belt 35 engaged into the belt groove provided on the circumference of stretching pulley 32. Nonwoven fabric 18 is also held at the other edge in the transverse direction by the periphery of stretching pulley 33 and circulating belt 35 which is engaged into the belt groove provided on the circumference of stretching pulley 33. In this way, nonwoven fabric 18 is held at both the edges in the width direction by stretching pulleys 32 and 33 and circulating belt 35, thus nonwoven fabric 18 is conveyed. During the conveyance of nonwoven fabric 18, nonwoven fabric 18 is stretched owing to the diverging arrangement of stretching pulleys 32 and 33 so that the distance between both the edges of nonwoven fabric 18 is enlarged. As a consequence, nonwoven fabric 18 is stretched in the transverse direction thereof within heated air chamber 31.

Nonwoven fabric 18 stretched in the transverse direction is brought apart from stretching pulleys 32 and 33 and circulating belt 35 at the widest portion of the locus of stretching pulleys 32 and 33. Stretched nonwoven fabric 18 is cooled by cooling cylinder 34 depending on necessity, and then conveyed to the outside of heated air chamber 31. Thus, there is produced transversely stretched nonwoven fabric 40 as a transversely aligned web in which nonwoven fabric 18 is transversely stretched during the above-described processes.

Now, the preferable mode of embodiment of a method of producing transversely aligned web and an apparatus for producing the same according too the present invention will be described.

Inventors et al. investigated the high speed spinning. The result of the investigation revealed a solution of problems upon the high speed spinning under the following condition. That is, as for spinning means, overall discussion was made on the spinning nozzle, the primary airflow nozzle, the secondary airflow nozzle, the internal structure of spinning head, spinning conditions, relation between these conditions and resulting products and so on. According to the investigations and discussions, the inventors et al. found a solution under the following conditions.

If the spinning is carried out with ordinary type of filaments, in particular, if the spinning is aiming at producing nonwoven fabric formed of filaments of which a diameter is 15 $\mu$m or less, the spinning nozzle is usually designed to have a diameter of 0.2 mm to 0.3 mm. If it is desired to spin filaments with a diameter of 15 $\mu$m or less, corresponding diameter of spinning nozzle will not exceed 0.5 mm. However, if it is also desired to carry out the spinning at a high rate such as in the case of the present invention, the spinning nozzle is requested to have a diameter, $N_z$ of 0.60 mm or more. It is desirable for the spinning nozzle to have a diameter of 0.65 mm or more. More desirably, the spinning nozzle is requested to have a diameter of 0.70 mm or more. However, it is undesirable for the spinning nozzle to have a diameter of 0.85 mm or more.

It is desirable for primary airflow nozzle 2 of a annular shape from which the primary airflow is blown off, to have an inner diameter, d of 2.5 mm or more. More desirably, the diameter is 3.0 mm or more. However, it is undesirable for the inner diameter of primary airflow nozzle 2 to be of 6.0 mm or more. In this case, a plurality of small apertures 3 from which a heated airflow is blown off downwardly, are provided around primary airflow nozzle 2 on the undersurface of spinning head 10. Thus, filaments can be spun with stability.

It is desirable for secondary airflow nozzles 4*a* and 4*b*, which are opposite to each other in the longitudinal direction of mesh belt 19, to have a diameter, r of ϕ1.5 mm or more. More desirably, the diameter is ϕ2.0 mm or more. However, it is undesirable for the diameter of secondary airflow nozzles 4*a* and 4*b* to be of ϕ6.0 mm or more. Further, it is desirable for a plural number of secondary airflow nozzles 4*a* and 4*b* to be provided on both the sides of melted resin extruded from spinning nozzle 1.

Setup distance H of spinning nozzle part 5 of a cylindrical shape serving as spinning nozzle 1 with the inner space thereof, i.e., the height H by which spinning nozzle part 5 projects at its lower surface from the surrounding portion of annular primary airflow nozzle 2, is desirably larger than zero and smaller than 1.0 mm. More desirably, the height falls within a range of from 0.1 mm to 0.5 mm.

Spinning head 10 desirably has a structure such that the spinning nozzle part and members constituting the primary airflow blowoff unit are unitarily formed. Further, as has been described with reference to FIG. 3, the flow passage provided within the spinning head 10 for making the primary airflow uniform, desirably has a shape of a annular nozzle of which the gap falls in a range of from 0.1 mm to 0.5 mm. With this arrangement, each member of spinning head 10 can be well aligned in terms of mechanical assemblage and the primary airflow can be blown off uniformly, with the result that filaments can be spun with stability. In this case, if the secondary airflow blowoff unit having secondary airflow nozzles 4*a* and 4*b* formed is also unitarily formed together with the spinning head, overall alignment of the spinning head will be further improved.

A spray gun for use for painting is an apparatus similar to spinning head 10 utilized in the method of producing the transversely aligned web according to the present invention. However, the spray gun has a smaller nozzle diameter than that of spinning head 10 according to the present invention. Also, the shape of the nozzle of the spray gun is not analogous to the nozzle of spinning head 10 according to the present invention.

Filaments spun by spinning head 10 at a high rate according to the present invention have a diameter of more than 10 μm and less than 30 μm. The diameter of the filaments is more desirably greater than 10 μm and less than 25 μm. An ordinary diameter of filaments is about 20 μm. If the diameter of filaments exceeds 30 μm, the filaments will not be sufficiently vibrated by the primary airflow upon spinning, with the result that spinning becomes unstable. Further, the resulting products have bad texture as a fabric. If the diameter of filaments is smaller than 10 μm, spinning also becomes unstable. Further, resulting web composed of such thinned filaments has a poor extendability. Filaments spun at a high rate by the method of production and apparatus for production according to the present invention are un-oriented filaments. If the web formed of such un-oriented filaments is stretched in the later process, the web can be stretched at five times or more in stretching ratio. The diameter of filaments after undergoing the stretching process becomes more than 5 μm and less than 15 μm. The diameter of filaments composing the transversely aligned web according to the present invention is substantially constant. The way of measuring the diameter of filaments will be concretely described later on. The term "diameter of filaments" in the description of the present invention means a mean value of diameters of filaments composing the transversely aligned web.

Multi-filaments spun by an ordinary high rate spinning have a diameter of about 20 μm. However, such filaments are subjected to molecular orientation at the timing point when they are spun at the high rate. Thus, it is almost impossible to stretch the filaments after being spun. Accordingly, the diameter of multi-filaments encounters a limitation in thinning the diameter. Thus, the diameter of an ordinary multi-filament tends to become larger than the diameter of filaments spun by the production method and production apparatus according to the present invention based on the comparison after stretching the filaments.

Further, the transversely aligned web according to the present invention is characterized by a filament piling body in which the filaments spun by the high rate spinning are piled on the conveyor so that the filaments are aligned in the transverse direction perpendicular to the running direction of the conveyor.

According to the nonwoven fabric made of the transversely aligned web produced by the high rate spinning of the present invention, a molecular orientation is substantially not caused in the filaments composing the nonwoven fabric. This fact is essentially different from that of multi-filaments of ordinary high rate spinning which are finally and directly subjected to molecular orientation at a degree sufficient to become a fiber.

Accordingly, the transversely aligned web of the present invention has a satisfactory elongation at a room temperature. That is, the transversely aligned web has an elongation of 70% or more in the direction in which the filaments are aligned. The elongation is desirably 100% or more, and more desirably 150% or more. It is believed that the merit of the nonwoven fabric, i.e., that the nonwoven fabric has a greater elongation in the direction in which the filaments are aligned, comes from the fact that the molecular orientation is not caused in the filaments, the filaments are rapidly cooled, and the filaments are well aligned, as described above.

The high rate spinning according to the producing method and producing apparatus of the present invention are characterized in that the obtained web can be made wide in proportion to the increase in quantity of melted resin extruded from the spinning nozzle. The high rate spinning according to the producing method and producing apparatus of the present invention are also characterized in that the filaments extend continuously over the width direction of the web. Thus, the transversely aligned web produced by the producing method and producing apparatus of the present invention comes to have a width of 300 mm or more, desirably 350 mm or more, more desirably 400 mm or more.

According to the producing method and producing apparatus of the present invention, it becomes possible to obtain filaments having a diameter of 10 μm to 30 μm by extruding melted resin from spinning nozzle 1 at a rate of 30 g/min. or more. Thus, filaments can be spun at a high rate, i.e., a rate of 30000 m/min. or more, desirably 70000 m/min. or more, more desirably 100000 m/min. or more.

High rate spinning of multi-filament is limited in its filament spinning rate to 7000 m/min. on an industrial base and to 10000 m/min. on an experimental base. The producing method and producing apparatus of the present invention achieves five times the spinning rate as compared with the above introduced multi-filament spinning rate. Furthermore, as described above, the high rate spinning of the present invention and the high rate spinning of the multi-filament are different from each other in the diameter of obtained filaments, the state of filament molecular orientation, the state of filament alignment and so on.

Further, as a method of spinning filaments at a high rate for producing nonwoven fabric, there can be named a spinning of melt-blow nonwoven fabric. However, according to the melt-blow spinning method, the rate of extruding melted resin per one spinning nozzle is at most 1 g/min. Further, if the melt-blow spinning method is an ordinary arranged one, the rate of extruding melted resin per one spinning nozzle will stay at a level of or become lower than one fiftieth of 30 g/min. that is the rate of extruding melted resin per one spinning nozzle of the present invention. However, according to the spinning of melt-blow system, the diameter of obtained filaments is thinned, or 3 $\mu$m, the rate of spinning is relatively high. But the rate of spinning is limited to about 20000 m/min. to 30000 m/min.

As described above, the high rate spinning of the present invention and the high rate spinning of the melt-blow system are different from each other in the diameter of obtained filaments. That is, as described above, the diameter of filaments obtained by the high rate spinning of the melt-blow system is smaller than that of the high rate spinning of the present invention. Of course the spinning based on the melt-blow system can be arranged to produce filaments of a large diameter. In this case, however, the rate of spinning will be decreased. The filaments produced by the spinning based on the melt-blow system share a common nature with filaments produced by the high rate spinning of the present invention in that the filaments undergo almost no molecular orientation. However, the filaments produced by the spinning based on the melt-blow system tend to suffer from damage during the process of spinning, with the result that the resulting nonwoven fabric produced by the spinning based on the melt-blow system has weak tensile strength and less elongation, which are inferior to the tensile strength and elongation of the transversely aligned web produced by the high rate spinning of the present invention. Furthermore, the filaments composing the melt-blow nonwoven fabric produced by the spinning based on the melt-blow system are cut at the length of several ten centimeters and not aligned in a single direction. Thus, the nonwoven fabric produced by the spinning based on the melt-blow system is a random nonwoven fabric.

A sound wave can transmit at a speed of 30000 m/min. in the heated air at a temperature of 300° C. Which fact means that the spinning rate of the present invention is more than the speed of a sound wave traveling in a heated wave, or in some cases, several times the speed of a sound wave. Thus, it is to say that the method of spinning according to the present invention is characterized by the above fact.

According to the above described method of producing the transversely aligned web of the present invention, the filaments composing the transversely aligned web are stretched after they are spun. In this case, it is necessary for the filaments to be cooled rapidly for the filaments to have a proper extendability. According to the method of producing the transversely aligned web of the present invention, the melted resin is extruded at considerably high rate, and hence the thermal capacity of the melted resin extruded from the spinning nozzle is relatively large, with the result that the cooling of the melted resin tends to be unsatisfactory. If the filaments are not cooled rapidly, crystallization is caused in the filaments. If the filaments having crystallization caused therein are stretched, the molecular system of the filament cannot help damaging the crystalline structure formed therein. Thus, if the transversely aligned web is formed of filaments which are not cooled rapidly upon the step of spinning, the transversely aligned web suffers from a large stretching stress and resulting stretch breaking of filaments at the stretch. Therefore, the transversely aligned web cannot be stretched at a high ratio.

According to the present invention, the filaments are cooled by airflow containing a mist-like moisture before the spun filaments reach the conveyor, whereby the filaments are cooled rapidly. This manner of cooling is the most effective in order to make the filaments have a high extendibility.

According to the present invention, the transversely aligned web formed of the filaments spun at the high rate is stretched in the transverse direction of the web, whereby the web is made to be tough against a tensile force applied in the transverse direction. According to the present invention, the web directly formed by aligning the filaments in the transverse direction does not have a sufficient width. Thus, the transversely aligned web is stretched in the transverse direction to make the web have a desired width. Thus, the transversely aligned web as a final product becomes more versatile. Moreover, if the transversely aligned web is stretched at a large magnification, the web is made to have a large width, correspondingly. Which makes the web more advantageous.

The means for transversely stretching the transversely aligned web of the present invention may be arranged similarly to a tenter type transversely stretching apparatus (tenter frame) which is utilized in a two-axis stretching of a film. Alternatively, the means for transversely stretching the transversely aligned web of the present invention may be arranged similarly to a pulley type transversely stretching apparatus which is disclosed in Japanese Patent Publication No. 36948/91. Alternatively, a transversely stretching apparatus may be arranged as a transversely stretching apparatus of a groove-roll system in which a pair of rolls having a groove provided thereon are combined and the web is stretched in the transverse direction between the rolls. An apparatus of a pulley type or an apparatus of a groove roll type is easy to use because of its simplicity.

The transversely aligned web of the present invention after being stretched may have a tensile strength in the stretching direction of the web of at least 132.5 mN/tex (1.5 g/d) or more, desirably 158.9 mN/tex (1.8 g/d) or more, more desirably 176.6 mN/tex (2.0 g/d) or more.

The transversely aligned web of the present invention can be utilized for reinforcing another web such as a sheet of nonwoven fabric, a sheet of paper, a film or the like in the transverse direction thereof. Further, the transversely aligned web of the present invention can be utilized as a transversely aligned web constituting a cross laminated nonwoven fabric which is disclosed in Japanese Patent Publication No. 36948/91 filed by the present applicant.

The material of the melted resin, or the polymer, which is utilized for spinning the filaments upon producing the transversely aligned web of the present invention, may be suitably composed of a thermoplastic resin, such as polyethylene, polypropylene, polyester, polyamide, polyvinyl chloride system resin, polyurethane, fluoroplastic system resin, or derivatives of these materials. In addition, polyvinyl alcohol system resin, polyacrylonitrile system resin or the like may be utilized with spinning means of a wet type and dry type.

Of the above-listed polymers, polypropylene, polyethylene terephthalate, nylon 6, nylon 66 exhibit good spinning properties. Therefore, these materials are particularly suitable for the high rate spinning of the present invention. Further, among these polymers, polymer of which viscosity stays in a range of from 100 poise to 1000 poise is particularly suitable for the high rate spinning of the present invention.

EXAMPLES 1 to 4

FIG. 7 is a table in which are listed experimental examples 1 to 4 and comparable examples 1 to 5 of transversely aligned webs and corresponding types of spinning heads, materials of melted resins extruded from the spinning head, and spinning conditions when the transversely aligned web is produced by the apparatus for producing the transversely aligned web having the above-described arrangement. FIG. 8 is a table in which are listed examples of spinning heads, corresponding dimensions of the spinning head, and corresponding experimental examples 1 to 4 and comparable examples 1 to 5 which the spinning head is utilized for producing.

As shown in FIG. 7, there are listed materials of melted resins, spinning conditions, and the result of experiments. As shown in FIG. 8, there are shown dimensions of the spinning head and corresponding experimental examples 1 to 4 and comparable examples 1 to 5 which the spinning head is utilized for producing. That is, the numbers of notation ① to ⑧ listed in column A in FIG. 7 indicate the type of spinning head of which dimensions are listed in FIG. 8.

In column B in FIG. 7, there are listed polymers extruded from the spinning heads of corresponding experimental examples and comparable examples, and a melt flow rate and a limiting viscosity number of the polymer. In column B in FIG. 7, reference symbol PP represents polypropylene, and MFR represents the melt flow rate of the resin. Further, reference symbol PET represents polyethylene terephthalate and IV value represents the limited viscosity number of the resin.

In column H in FIG. 7, there are listed diameters of fibers. The listed data are determined in such a manner that 100 filaments uniformly sampled in the transverse direction of the web are measured by means of a microscope set at 1000 times magnification ratio. Thereafter, the data obtained by the measurement are subjected to a numerical processing, i.e., an averaging, and then listed as shown in column H in FIG. 7. The attached numerical notation with % indicates a coefficient of the fluctuation upon averaging.

In column I in FIG. 7, there are listed spinning rates which are determined by calculating the following Equation 1 where Q is substituted with the rate of extrusion of melted resin and D is substituted with the mean value of the above averaged fiber diameters. The dimensions of Y (the spinning rate) is m/min. In the following Equation 1, the dimension of Q (the rate of extrusion of melted resin) is g/min. while dimension of D (the diameter of the fiber of transversely aligned web) is $\mu$m. In this case, $\rho$ [g/cm$^3$] (density) is 1.34 when the material of melted resin is RET and 0.90 when the material of the melted resin is PP. $\pi$ represents the ratio of circumference of a circle to its diameter.

$$Y[\text{m/min.}] = \frac{Q[\text{g/min.}] \times 10^8[\mu\text{m}^2/\text{cm}^2])}{\pi \times \rho[\text{g/cm}^3] \times (D[\mu\text{m}]/2)^2 \times 10^2[\text{cm/m}]} \quad \text{[Equation 1]}$$

In column J in FIG. 7, there are listed numerals indicating tensile strength and elongation before stretching. The tensile strength and elongation are measured in the transverse direction under condition that the web is not stretched and placed at a temperature of 20° C. When tensile strength and elongation are measured, a sheet of web having a longitudinal direction of 50 mm is chucked with a portion of the web in the transverse direction to be 50 mm, and the web is elongated in the transverse direction at a rate of 100 mm/min.

In column K in FIG. 7, there are listed numerals indicating a stretching magnification ratio. The stretching magnification ratio is ideally defined so that a piece of web having a length of 50 mm in the transverse direction and width of 50 mm is held by a chucking device and this web is stretched in the transverse direction in hot water until the piece of web is broken, whereby the stretching magnification ratio just before the web is broken is determined. In actual practice, the stretching magnification ratio just before the web is broken is determined in such a manner that the web is subjected to a preparatory stretching as an experimental process so that a stretching magnification ratio at which the web starts breaking is determined, and thus a value which is 0.1 times (10%) less than the determined stretching magnification ratio is newly defined as the stretching magnification ratio. Then, the obtained stretching magnification ratio is utilized as a measuring sample of the "tensile strength and elongation after stretching" which is listed in column L of FIG. 7 and will be described later on. A stretching temperature, i.e., a temperature of hot water of a laboratory for measuring the tensile strength and elongation before stretching, is 98° C. for PP and 70° C. for PET.

The tensile strength and elongation after stretching listed in column L of FIG. 7 are respectively tensile strength and elongation in the stretching direction of the web having undergone the stretching process. When the tensile strength and elongation are measured, a sheet of web having a longitudinal direction of 50 mm is chucked so that the chucked portion distance is 100 mm, and the web is elongated in the transverse direction at a rate of 100 mm/min.

As shown in FIG. 8, there are listed variously determined numerals as dimensions of respective parts of the spinning head, such as the nozzle diameter $N_z$ of spinning nozzle 1, the inner diameter d of primary airflow nozzle 2, the outer diameter D of the same nozzle, the projection height H of spinning nozzle part 5, the inner diameter q of small aperture 3, the diameter r of secondary airflow nozzle 4*a*, and the smallest gap S of the annular aperture communicated with primary airflow nozzle 2 within spinning head 10. These dimensions of respective parts of the spinning head are determined for each of experimental examples 1 to 4 and comparable examples 1 to 5.

Each of the experimental examples 1 to 4 of FIG. 7 is a web formed of filaments spun at a spinning rate of 30000 m/min or more when the spinning head having an arrangement shown in FIGS. 1A, 1B and 3 has proper dimensions for respective parts. In each of the cases, it was possible to produce a transversely aligned web having a width of 300 mm or more in which filaments extend continuously in the width direction of the web. Also in this case, the filaments composing the transversely aligned web have an average diameter of more than 10 $\mu$m and less than 30 $\mu$m, and the elongation of the transversely aligned web in the transverse direction is 70% or more.

When the transversely aligned web is stretched in the transverse direction, there can be obtained a transversely aligned and transversely stretched web which is formed of filaments with a diameter of more than 5 $\mu$m and less than 15 $\mu$m and has a tensile strength in the stretching direction of 132.5 mN/tex (1.5 g/d) or more.

The stretching in the transverse direction applied on the experimental examples and the comparable examples was a stretching in the transverse direction on a laboratory base. However, if the transversely aligned web is stretched by a transversely stretching apparatus of a heat-air system using pulleys shown in FIGS. 6A and 6B, then it became possible to stretch the web formed of PP as in the experimental example 1 in the transverse direction at a magnification ratio of 6.5 times in a heated air environment at a temperature of 120° C. Also, it became possible to obtain the transversely stretched web having a tensile strength of 220.8 mN/tex (2.5 g/d) and an elongation of 12% in the stretching direction. As for the web of the experimental example 2 formed of PET, by using the transversely stretching apparatus shown in FIGS. 6A and 6B, it became possible to obtain a web which could be stretched in the transverse direction at a magnification ratio of 5.8 times in a heated air environment at a temperature of 87° C. Also, the obtained web had a tensile strength of 167.8 mN/tex (1.9 g/d) and an elongation of 10% in the stretching direction.

As for the minimum gap S of the annular passage for making the primary airflow uniform within spinning head 10, spinning at a high extrusion rate exhibited higher stability upon the minimum gap S of 0.5 mm rather than upon the minimum gap S of 1.0 mm. Although there is no comparable example available, when the minimum gap S is smaller than 0.1 mm, the spinning condition would be considerably influenced by the mechanical precision of the annular passage, with the result that the stability of spinning conversely became poor.

The comparable examples 1 to 5 of FIG. 7 are examples in which negative results were observed due to improper selection of some dimensions of spinning head 10. More concretely, the comparable example 1 is produced by the spinning head of No. 4 in which the nozzle diameter $N_z$ is smaller than 0.60 mm. Comparable example 2 is produced by the spinning head of No. 5 in which the nozzle diameter $N_z$ is larger than 0.90 mm. Comparable example 3 is produced by the spinning head of No. 6 in which the inner diameter d of primary airflow nozzle 2 is larger than 6 mm. And the comparable example 5 is produced by the spinning head of No. 8 in which the inner diameter r of the secondary airflow nozzle is smaller than 1.5 mm. The spinning heads of the above cases were unsuitable for high rate spinning due to instability of spinning at a high extrusion rate and weak tensile strength after stretching process.

Although not listed in the tables of FIGS. 7 and 8 as a comparable example, if the inner diameter d of primary airflow nozzle 2 is smaller than 2.0 mm, also the spinning cannot be carried out with stability.

All of the web obtained as the experimental examples 1 to 4 were produced in such a manner that the filaments were cooled by air containing mist-like moisture before the spun filaments reached the conveyor. However, if the web was produced under the same conditions of the experimental example 1 or 2 except that the spun filaments were not cooled by air containing mist-like moisture, the obtained transversely aligned web failed to have a stretching magnification ratio of 5 times or more even under measurement of stretching magnification ratio of a laboratory base, and further the tensile strength in the transverse direction could not reach 88.3 mN/tex (1 g/d).

As shown in the column of note in FIG. 7, a grain-like resin ball can be caused within the web or the profile of web can become extremely unusual as will be described later on, depending on the various dimensions and spinning condition of the spinning head. The grain caused within the web extends from a small one such as of 0.2 to 0.3 mm (small grain) to a large one exceeding 1.0 mm. (large grain). If the number of grains are large or the size of the grain is large, the stretching magnification stays within a low level and the tensile strength of the web after being stretched is weak.

The resulting products do not have a uniform profile of filament distribution in the transverse direction of the web. That is, the web has a profile having slightly thick portion at both the sides in the transverse direction of the web. In this case, the term "profile" means a distribution of mass in the transverse direction of the transversely aligned web. Such profile is measured in the following manner.

Initially, a piece of web having a length of 100 mm in longitudinal direction is sampled over the whole width of the transversely aligned web which is produced as a product. Then, the width of the sampled transversely aligned web is measured.

Next, the sampled transversely aligned web of the length of 100 mm is cut at a width of 25 mm in a direction perpendicular to the aligned direction of filaments composing the transversely aligned web, and each mass of the resultant cut pieces of the web is measured.

Then, the distribution of mass in the transverse direction of the transversely aligned web is plotted based on the data obtained by measuring each mass of the pieces of the web cut at a width of 25 mm. In this way, there can be obtained a profile of the transversely aligned web as a distribution of mass in the transverse direction of the transversely aligned web.

Figure 9A:
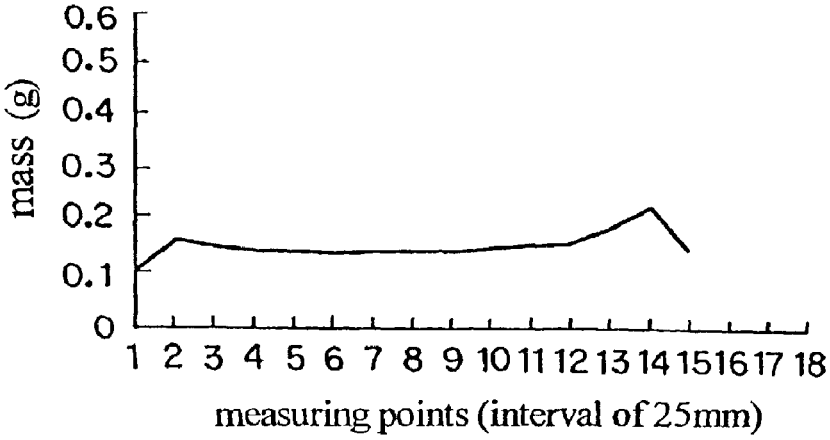
FIGS. 9A to 9C are diagrams each showing a representative example of a distribution profile of the mass extending along the transverse direction of the transversely aligned web.
Figure 9B:
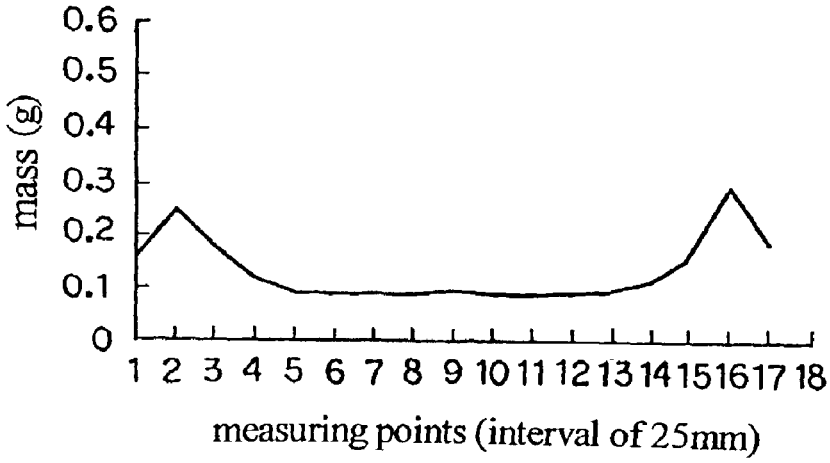
Figure 9C:
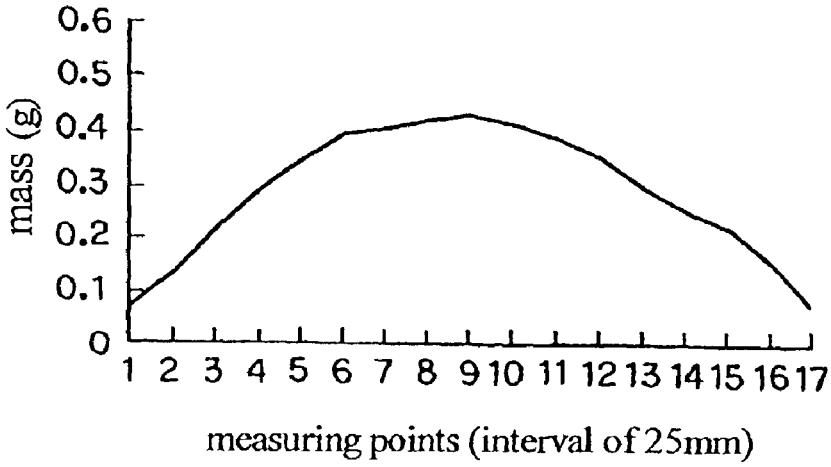
Figure 10A:
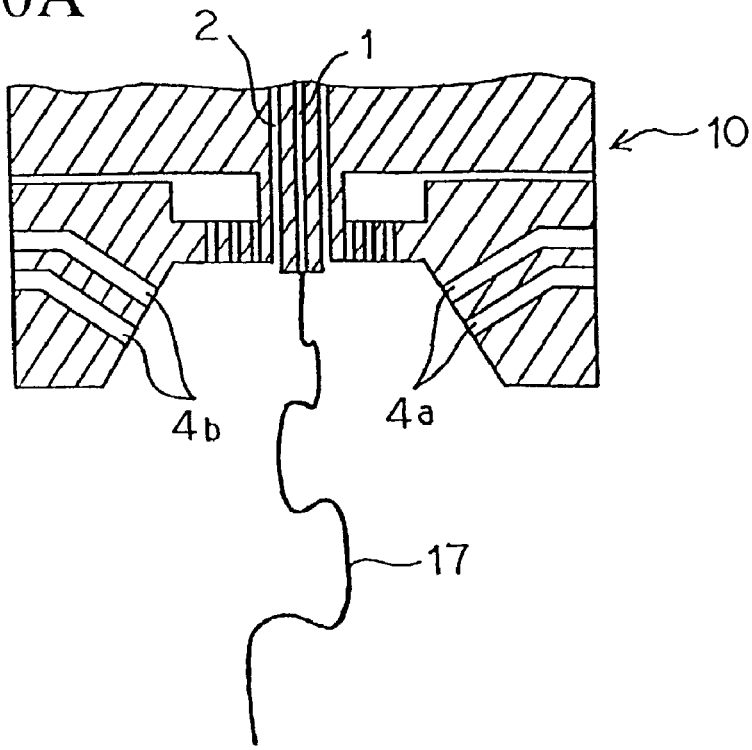
FIG. 10A is a diagram showing a cross-section of the spinning head as viewed from a direction perpendicular to the running direction of the mesh belt and a melted polymer extruded from the spinning head, to which reference is made for explaining the extruded melted polymer vibrated by a primary airflow blown off from the primary airflow nozzle.
Figure 10B:
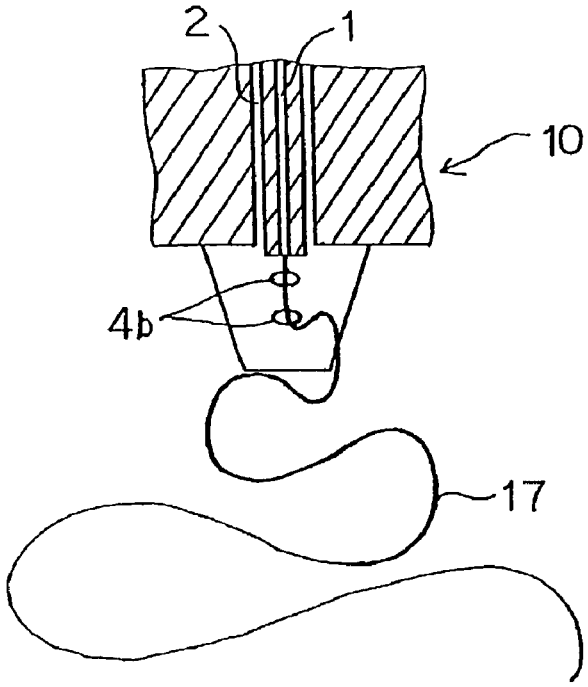
FIG. 10B is a diagram showing a cross-section of the spinning head as viewed from the downstream side of the running direction of the mesh belt and the melted polymer extruded from the spinning head, to which reference is made for explaining the extruded melted polymer vibrated by a primary airflow blown off from the primary airflow nozzle.

FIGS. 9A, 9B and 9C are diagrams each showing a representative example of profile as a distribution of mass in the transverse direction of the transversely aligned web. FIG. 9A shows a flat type profile, FIG. 9B shows a dumbbell-type profile, and FIG. 9C shows a hill-type profile. The axis of abscissa represents measuring points taken at an interval of 25 mm while the axis of ordinate represents mass (g).

The flat type profile shown in FIG. 9A represents a substantially uniform mass distribution in the transverse direction of the transversely aligned web. The dumbbell-type profile shown in FIG. 9B represents that the transversely aligned web becomes thick at both the edge portions in the transverse direction as compared with the thickness at the center portion thereof, and thus the web weighs more at the edges than at the center portion thereof. The hill-type profile shown in FIG. 9C shows that the transversely aligned web becomes thick at the center portion thereof as compared with the thickness at both the edge portions in the transverse direction, and thus the web weighs more at the center portion than at the edges thereof.

As in the spinning nozzle of No. 7 for producing the comparable example 4, if the projecting height H of spinning nozzle part 5 is zero or below, that is, the lower end of spinning nozzle part 5 is recessed with respect to the horizontal surface of airflow blowoff unit 6, then spinning can be carried out at a high rate and resulting web has a high tensile strength after stretching process. However, in this case, as was noted in the column of note of FIG. 7, the web comes to have a profile of the excessive dumbbell shape as shown in FIG. 9B, with the result that the product after undergoing the stretching process in the transverse direction is deteriorated. On the other hand, if the projecting height H is a large value, e.g., 0.5, as in the spinning nozzle of No. 6 for producing the comparable example 3, the web comes to have a hill-like profile as shown in FIG. 9C, as was noted in the column of note of FIG. 7.

While preferred embodiments of the present invention have been described using specific terms, such descriptions are for illustrative purposes only, and it is to be understood that changes and variations may be made without departing from the spirit or scope of the following claims.

What is claimed is:

1. An apparatus for producing a transversely aligned web having filaments aligned in the transverse direction, comprising:

a conveyor running in one direction;

a spinning nozzle disposed above the conveyor and having an inner diameter of a range from 0.6 mm to 0.85 mm for extruding a melted resin downwardly;

an annular primary airflow nozzle having a diameter of at least 2.5 mm formed around the spinning nozzle so as to be concentric with the opening end of the spinning nozzle for blowing off a primary airflow at a high temperature and at a high velocity in the gravitational direction so that a melted filament extruded from the opening end of the spinning nozzle is vibrated; and at least one pair of secondary airflow nozzles disposed on the upstream side and the downstream side of the running direction of the conveyor with respect to the extruded melted filament vibrated by the primary airflow, blowing off secondary airflow at a high temperature toward the extruded melted filament vibrated by the primary airflow so that the secondary airflows blown off from the secondary airflow nozzles on the upstream side and the downstream side of the running direction of the conveyor with respect to the extruded melted filament, respectively, collide with each other below the spinning nozzle.

2. The apparatus for producing a transversely aligned web according to claim 1, wherein the spinning nozzle is formed into a cylindrical spinning nozzle part, the annular primary airflow nozzle is formed around the spinning nozzle part, the spinning nozzle part and the annular primary airflow nozzle constitute a spinning head, and the spinning head is disposed above the conveyor, and the spinning nozzle part is projected at the lower surface thereof relative to the surrounding portion of the annular primary airflow nozzle of the spinning head by 0.01 mm to 1.00 mm.

3. The apparatus for producing a transversely aligned web according to claim 1, wherein a diameter of the opening end of the secondary airflow nozzle is at least 1.5 mm.

4. The apparatus for producing a transversely aligned web according to claim 1, further comprising a plurality of blowoff nozzles provided on the outside of the annular nozzle blowing off the primary airflow and different from the secondary airflow blowoff nozzles, whereby a heated airflow is blown off from the plurality of blowoff nozzles so that the filaments deriving from solidifying the melted filaments extruded from the spinning nozzle are spun with stability.

5. The apparatus for producing a transversely aligned web according to claim 4, wherein the plurality of blowoff nozzles different from the secondary airflow blowoff nozzles are provided on the upstream side and downstream side of the conveyor running direction with respect to the spinning nozzle so that the plurality of blowoff nozzles are aligned on one straight line in parallel with the running direction of the conveyor.

6. The apparatus for producing a transversely aligned web according to claim 4, wherein the plurality of blowoff nozzles different from the secondary airflow blowoff nozzles are disposed at a regular interval on a circle which concentrically surrounds the open end of the spinning nozzle.

7. The apparatus for producing a transversely aligned web according to claim 1, wherein the spinning nozzle is formed into a cylindrical spinning nozzle part, the annular primary airflow nozzle is formed around the spinning nozzle part, the spinning nozzle part and the annular primary airflow nozzle constitute a spinning head, and the spinning head is disposed above the conveyor, and the spinning head has provided therein a nozzle passage which communicates with the annular primary airflow nozzle and has a gap of which dimension at least partly ranges from 0.1 mm to 0.5 mm, whereby the primary airflow blown off from the annular primary airflow nozzle becomes a uniform velocity and temperature.

* * * * *